US007702261B2

(12) United States Patent
Yasuda

(10) Patent No.: US 7,702,261 B2
(45) Date of Patent: Apr. 20, 2010

(54) DEVELOPMENT DEVICE AND METHOD CAPABLE OF MAINTAINING TONER CONCENTRATION AT CONSTANT LEVEL WITHOUT SHORTENING LIFE OF DEVELOPER, PROCESS CARTRIDGE, AND IMAGING FORMING APPARATUS

(75) Inventor: Yuji Yasuda, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 462 days.

(21) Appl. No.: 11/373,162

(22) Filed: Mar. 13, 2006

(65) Prior Publication Data

US 2006/0204283 A1 Sep. 14, 2006

(30) Foreign Application Priority Data

Mar. 11, 2005 (JP) ..... 2005-068659

(51) Int. Cl.
*G03G 15/08* (2006.01)

(52) U.S. Cl. ..... 399/254

(58) Field of Classification Search ..... 399/252–258
See application file for complete search history.

(56) References Cited

U.S. PATENT DOCUMENTS 5,722,002 A * 2/1998 Kikuta et al. ..... 399/30
2003/0156859 A1* 8/2003 Tamai ..... 399/254

FOREIGN PATENT DOCUMENTS

| | | |
|---|---|---|
| JP | 09-146355 | 6/1997 |
| JP | 11-167260 | 6/1999 |
| JP | 11-202626 | 7/1999 |
| JP | 3127594 | 11/2000 |
| JP | 2002-072642 | 3/2002 |
| JP | 2004-077587 | 3/2004 |

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

A development device includes a developer bearing member including a plurality of magnetic poles for bearing a two component developer, and rotating so that the toner is supplied to a latent image bearing member, a supply and conveyance path including a member configured to convey the developer in a first direction, a regulation member configured to regulate the developer on the developer bearing member, a collection and conveyance path including a member configured to convey the developer in a second direction parallel to the first direction, arranged below the development bearing member and at a substantially same height as the supply and conveyance path, an agitation and conveyance path including a member configured to convey the developer in a third direction opposite to the first direction, arranged at a substantially same height as the collection and conveyance path, and partition members partitioning the three paths.

23 Claims, 13 Drawing Sheets

DEVELOPMENT DEVICE AND METHOD CAPABLE OF MAINTAINING TONER CONCENTRATION AT CONSTANT LEVEL WITHOUT SHORTENING LIFE OF DEVELOPER, PROCESS CARTRIDGE, AND IMAGING FORMING APPARATUS

BACKGROUND OF THE INVENTION

1. Field of the Invention

The present invention relates to a development device and method used in a copier, a facsimile machine, a printer, and so forth, and more particularly to a development device and method using a two component developer including toner and a magnetic carrier, capable of maintaining a toner concentration at a constant level without shortening the life of the developer, and a process cartridge and image forming apparatus using the development device.

2. Discussion of the Background

A background development device using a two component developer including toner and a magnetic carrier has a configuration shown in FIG. 1. As shown in FIG. 1, a development device 4*a* includes a development roller 5*a* serving as a developer bearing member, an agitation and conveyance path 10*a*, an agitation and conveyance auger 11*a* serving as an agitation and conveyance member, a supply and collection auger 401, a supply and collection path 402, and a partition 403 serving as a partition member.

The agitation and conveyance path 10*a* includes the agitation and conveyance auger 11*a*, while the supply and collection path 402 includes the supply and collection auger 401. As shown in FIG. 1, the supply and collection auger 401 and the agitation and conveyance auger 11*a* are arranged side by side in a horizontal direction. The agitation and conveyance path 10*a* and the supply and collection path 402 are partitioned by the partition 403. The partition 403 includes an opening at each end in a longitudinal direction thereof, connecting the agitation and conveyance path 10*a* and the supply and collection path 402.

The supply and collection auger 401 supplies developer to the development roller 5*a*. The development roller 5*a* supplies the developer to a latent image bearing member (not shown). The supply and collection auger 401 then collects developer having been used for development from the development roller 5*a*. The collected developer is conveyed to a downstream end in a conveyance direction of the supply and collection auger 401, and is transferred into the agitation and conveyance path 10.

The agitation and conveyance auger 11*a* is provided with the collected developer, and toner as necessary. While agitating the developer and the toner, the agitation and conveyance auger 11*a* conveys the developer mixed with the toner in a direction opposite to the conveyance direction of the supply and collection auger 401.

The developer is circulated in the agitation and conveyance path 10*a* and the supply and collection path 402 through the openings of the partition 403.

When the developer is used for development, a toner concentration of the developer decreases as the toner is consumed for development. Therefore, the collected developer has a toner concentration lower than a toner concentration of the developer yet to be used for development.

In the development device 4*a*, as the developer is supplied and collected by the same auger by using the same path, the collected developer is mixed with the developer yet to be used for development during agitation. As a result, the toner concentration of the developer to be supplied to the development roller 5*a* is lower as the developer is conveyed further downstream in the supply and collection path 402. Especially when an image with high coverage is developed, the development consumes a large amount of toner and significantly lowers the toner concentration of the developer at a downstream side in the conveyance direction, resulting in a problem such that image quality may hardly be maintained.

Increasing an amount of developer to be conveyed can solve the problem. However, an increase in the amount of developer imposes increased stress on the developer, causing a shortening of life of the developer.

The above problem can be solved by separately providing an auger for supplying developer to a development roller and an auger for collecting developer having been used for development in different conveyance paths.

Configurations of development devices 4*b*, 4*c*, and 4*d* each provided with the different conveyance paths are described below referring to FIGS. 2, 3, and 4, respectively.

As shown in FIG. 2, the development device 4*b* includes a development roller 5*b*, a supply and conveyance auger 8*b*, a supply and conveyance path 9*b*, a collection and agitation auger 110, an accumulation prevention auger 209, a collection and agitation path 210, and a partition 403*b* serving as a partition member.

The supply and conveyance path 9*b* includes the supply and conveyance auger 8*b*, while the collection and agitation path 210 includes the collection and agitation auger 110. The supply and conveyance auger 8*b* is arranged above the collection and agitation auger 110. The supply and conveyance path 9*b* and the collection and agitation path 210 are partitioned by the partition 403*b*. The partition 403*b* includes an opening at each end in a longitudinal direction thereof, connecting the supply and conveyance path 9*b* and the collection and agitation path 210.

The supply and conveyance auger 8*b* supplies developer to the development roller 5*b* while conveying the developer. The developer passes by a development area on the development roller 5*b*, and is collected into the collection and agitation path 210. Surplus developer conveyed to a downstream end in the supply and conveyance path 9*b* without being used for development falls through one of the openings located at the downstream end therein into the collection and agitation path 210.

The collection and agitation auger 110 agitates and conveys the collected and surplus developer in a direction opposite to a conveyance direction of the supply and conveyance auger 8*b*. The conveyed developer is jammed into a downstream end in the collection and agitation path 210, and rises therein by conveyance force of the collection and agitation auger 110. As a result, the developer is supplied through the other opening located in the downstream end therein into the supply and conveyance path 9*b*.

The collection and agitation path 210 is provided with the accumulation prevention auger 209 for preventing excessive developer from accumulating at the downstream end therein, and for conveying the excessive developer in an upstream direction.

In the development device 4*b*, the developer having been used for development is collected into the collection and agitation path 210, and is not mixed into the supply and conveyance path 9*b*. Therefore, the developer in the supply and conveyance path 9*b* maintains a toner concentration at a constant level, and as a result, the development roller 5*b* is supplied with the developer having a constant toner concentration.

As shown in FIG. 3, the development device 4*c* includes a development roller 5*c*, a collection and conveyance auger 6*c*, a collection and conveyance path 7*c*, a supply and conveyance auger 8*c*, a supply and conveyance path 9*c*, an agitation and conveyance path 10*c*, an agitation and conveyance auger 11*c*, first and second partitions 404 and 405 serving as partition members.

The supply and conveyance path 9*c* includes the supply and conveyance auger 8*c*, while the agitation and conveyance path 10*c* includes the agitation and conveyance auger 11*c*. The supply and conveyance auger 8*c* is arranged above the agitation and conveyance auger 11*c*. The supply and conveyance path 9*c* and the agitation and conveyance path 10*c* are partitioned by the first partition 404. The first partition 404 includes an opening at each end in a longitudinal direction thereof, connecting the supply and conveyance path 9*c* and the agitation and conveyance path 10*c*.

The collection and conveyance path 7*c* includes the collection and conveyance auger 6*c*. The collection and conveyance path 7*c* and the agitation and conveyance path 10*c* are arranged side by side in a horizontal direction, and are partitioned by the second partition 405. The second partition 405 includes an opening at a downstream end in a conveyance direction of the collection and conveyance auger 6*c*, connecting the collection and conveyance path 7*c* and the agitation and conveyance path 10*c*.

The supply and conveyance auger 6*c* supplies developer to the development roller 5*c* while conveying the developer in the same conveyance direction as the collection and conveyance auger 6*c*. The developer passes by a development area on the development roller 5*c*, and is collected into the collection and conveyance path 7*c*. The collection and conveyance auger 6*c* conveys the collected developer to the downstream end in the conveyance direction thereof. The collected developer is transversely transferred into the agitation and conveyance path 10*c* through the opening of the second partition 405.

Surplus developer conveyed to a downstream end in the supply and conveyance path 9*c* without being used for development falls through one of the openings located at the downstream end therein into the agitation and conveyance path 10*c*.

The agitation and conveyance auger 11*c* agitates and conveys the surplus and collected developer in a direction opposite to the conveyance direction of the supply and conveyance auger 8*c*. The conveyed developer is jammed into a downstream end in the agitation and conveyance path 10*c*, and rises therein by conveyance force of the agitation and conveyance auger 11*c*. As a result, the developer is supplied through the other opening located in the downstream end therein into the supply and conveyance path 9*c*.

In the development device 4*c*, the developer having been used for development is collected into the collection and conveyance path 7*c*, and is not mixed into the supply and conveyance path 9*c*. Therefore, the developer in the supply and conveyance path 9*c* maintains a toner concentration at a constant level, and as a result, the development roller 5*c* is supplied with the developer having a constant toner concentration.

As shown in FIG. 4, the development device 4*d* includes a development roller 5*d*, a collection and conveyance auger 6*d*, a collection and conveyance path 7*d*, a supply auger 440, a conveyance auger 450, a supply and conveyance path 9*d*, an agitation and conveyance path 10*d*, an agitation and conveyance auger 11*d*, first and second partitions 404*d* and 405*d* serving as partition members.

The collection and conveyance path 7*d* includes the collection and conveyance auger 6*d* arranged above the conveyance auger 450. The supply and conveyance path 9*d* includes the supply and conveyance augers 440 and 450 arranged next to each other. The agitation and conveyance path 10*d* includes the agitation and conveyance auger 11*d*. The supply and conveyance augers 440 and 450, and the agitation and conveyance auger 11*d* are arranged in a substantially horizontal direction.

The supply and conveyance path 9*d* and the agitation and conveyance path 10*d* are arranged side by side, and partitioned by the first partition 404*d*. The first partition 404*d* includes an opening at each end in a longitudinal direction thereof, connecting the supply and conveyance path 9*d* and the agitation and conveyance path 10*d*.

The collection and conveyance path 7*d* arranged above the supply and conveyance path 9*d*, and the supply and conveyance path 9*d* are partitioned by the second partition 405*d*. The second partition 405*d* includes an opening at a downstream end in a conveyance direction of the collection and conveyance auger 6*d*, connecting the collection and conveyance path 7*d* and the supply and conveyance path 9*d*.

The supply auger 440 supplies developer to the development roller 5*d* while conveying the developer. The conveyance auger 450 conveys the developer in the same conveyance direction as the supply auger 440. The developer is collected from the development roller 5*d* at a higher position than a position in which the supply auger 440 faces the development roller 5*d*. The collection and conveyance auger 6*d* conveys the collected developer to the downstream end in the same conveyance direction as the supply and conveyance augers 440 and 450. The collected developer falls through the opening of the second partition 405*d* into the supply and conveyance path 9*d*.

Surplus developer conveyed to a downstream end in the supply and conveyance path 9*d* by the supply and conveyance augers 440 and 450 without being used for development is, together with the collected developer, transversely transferred through one of the openings of the first partition 404*d* located at the downstream end therein into the agitation and conveyance path 10*d*.

The agitation and conveyance auger 11*d* conveys the surplus and collected developer to a downstream end in a direction opposite to the conveyance direction of the supply and conveyance augers 440 and 450. The surplus and collected developer is transversely transferred through the other opening of the first partition 404*d* located at the downstream end therein into an upstream side of the supply and conveyance path 9*d*.

In the development device 4*d*, the developer having been used for development is collected into the collection and conveyance path 7*d*, and is less likely to be mixed into the supply and conveyance path 9*d*. Therefore, compared with the development device 4*a*, the developer to be supplied to the development roller 5*d* has smaller fluctuations in toner concentration. Further, as the developer is substantially horizontally circulated in the development device 4*d*, shortening of life of developer attributed to forced upward transferring of developer can be prevented.

SUMMARY OF THE INVENTION

A development device according to the present invention includes a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member, a developer supply and conveyance path including a developer supply and conveyance member configured to convey the developer in a first direction parallel to an axial direction of the developer bearing member, a developer regulation member configured to regulate the developer on the developer bearing member, a developer collection and conveyance path including a developer collection and conveyance member configured to convey the developer in a second direction parallel to the first direction, arranged below the development bearing member and at a substantially same height as a height of the developer supply and conveyance path, a developer agitation and conveyance path including a developer agitation and conveyance member configured to convey the developer in a third direction opposite to the first direction, arranged at a substantially same height as the height of the developer collection and conveyance path, and partition members partitioning the developer supply and conveyance path, the developer collection and conveyance path, and the developer agitation and conveyance path.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
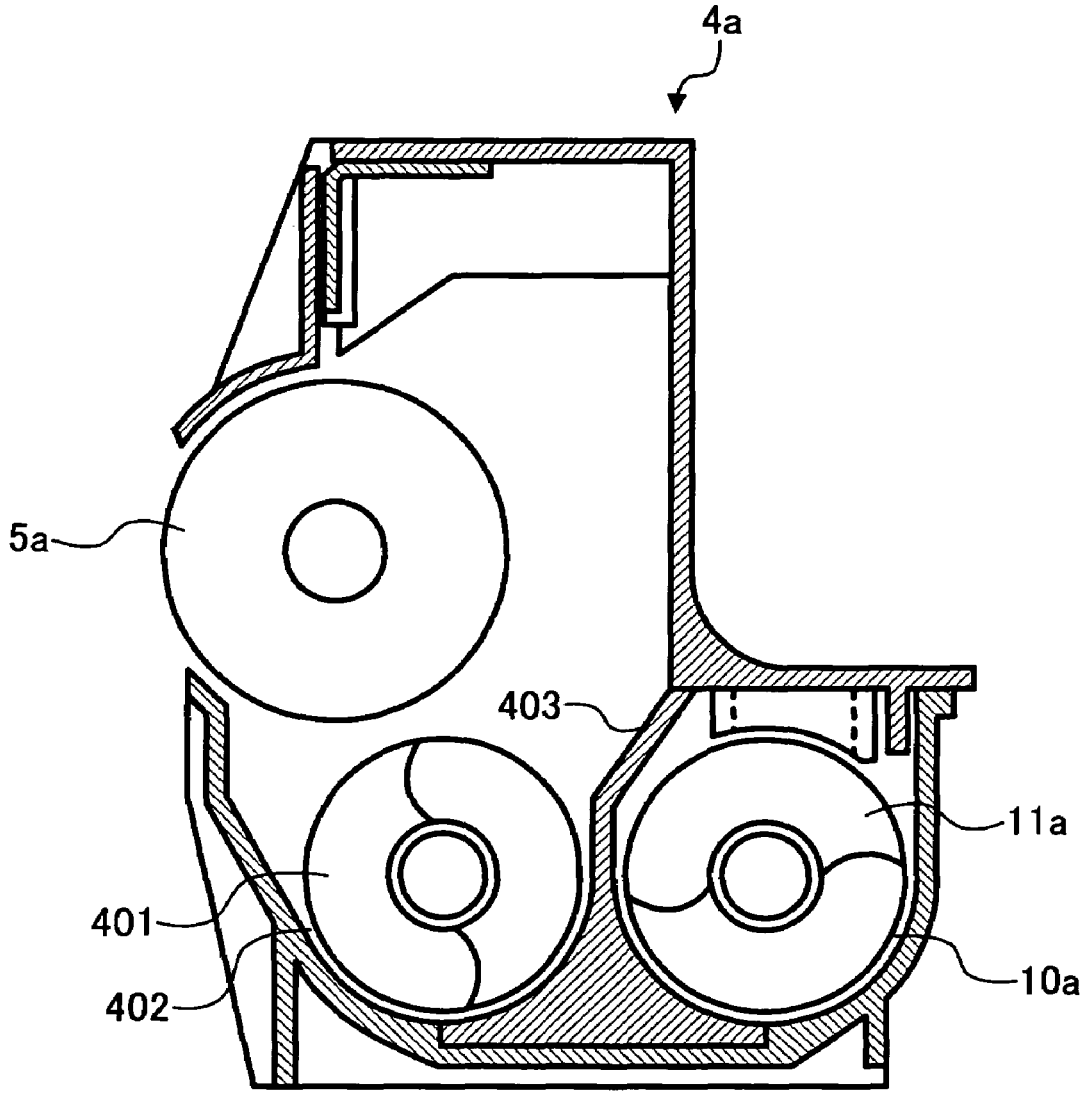
FIG. 1 BACKGROUND ART
FIG. 1 is a schematic illustration of a configuration of a background development device.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 5 and 6, a development device according to a preferred embodiment of the present invention is described.

Figure 5:
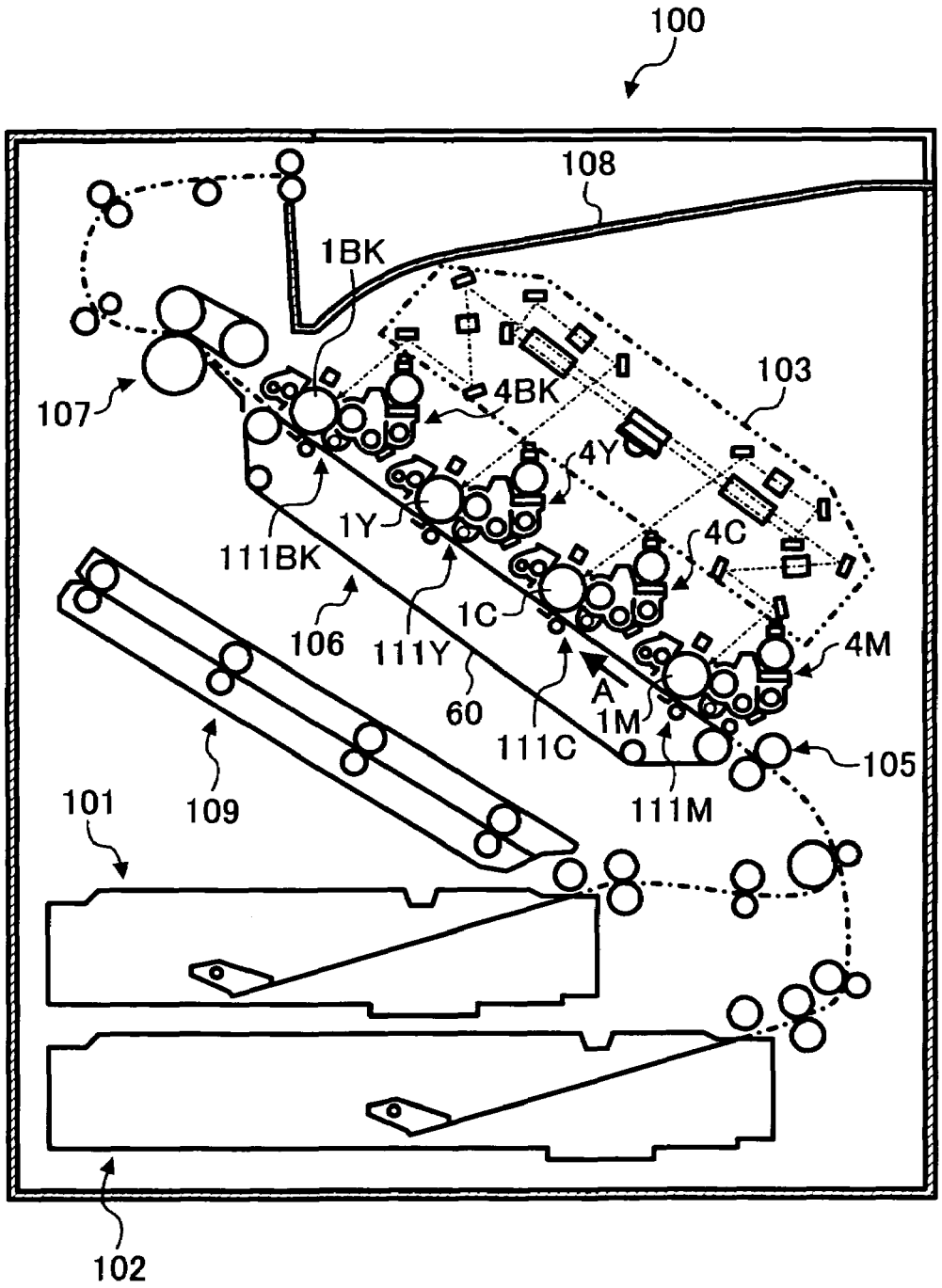
FIG. 5 is a schematic illustration of a configuration of a printer according to an embodiment of the present invention.

A general configuration of a color laser printer adopting an electronographic method serving as an image forming apparatus is described below referring to FIG. 5. As shown in FIG. 5, a printer 100 includes a transfer belt 60, a first sheet-feeding cassette 101, a second sheet-feeding cassette 102, an optical writing unit 103, a pair of registration rollers 105, a transfer unit 106, a fixing unit 107 adopting a belt fixing method, a sheet discharge tray 108, a reverse unit 109, image forming units 111M, 111C, 111Y, and 111BK (hereinafter the suffixes M, C, Y, and BK to a reference numeral represent magenta, cyan, yellow, and black, and members with the reference numerals having the suffixes M, C, Y, and BK represent members for the respective colors), and so forth. The printer 100 further includes a manual feeding tray, a toner supply container, a waste toner bottle, a power supply unit (not shown), and so forth.

The image forming units 111M to 111Bk include photoconductor drums 1M, 1C, 1Y, and 1BK, respectively, and development devices 4M, 4C, 4Y, and 4BK, respectively.

The optical writing unit 103 includes a light source, a polygon mirror, an f-θ lens, a reflection mirror (not shown), and so forth.

The image forming units 111M, 111C, 111Y, and 111BK configured to form toner images in the respective colors are arranged in the order from an upstream side along a conveyance direction of a transfer sheet serving as a transfer member (a direction of an arrow A in FIG. 5). Further, the image forming units 111M to 111BK are arranged such that axes of rotation of the photoconductor drums 1M to 1BK included in corresponding photoconductor units are parallel to each other and that the photoconductor drums 1M to 1BK are aligned at predetermined intervals in the conveyance direction. The image forming units 111M to 111BK are provided as a process cartridge which can be attached to and detached from the printer 100.

The transfer belt 60 serves as a transfer member conveyance belt for conveying a transfer sheet to transfer devices opposing to respective photoconductor drums 1M to 1BK. The pair of registration rollers 105 supplies the transfer sheet to the transfer belt 60.

The optical writing unit 103 scans surfaces of the photoconductor drums 1M to 1BK with laser light based on image data.

An alternate long and short dashed line in FIG. 5 indicates a conveyance route of a transfer sheet. A transfer sheet fed from selected one of the first sheet-feeding cassette 101 and the second sheet-feeding cassette 102 is conveyed by a conveyance roller by being guided by a conveyance guide (not shown) into a suspension position in which the pair of registration rollers 105 is disposed. The transfer sheet is then fed to the transfer belt 60 by the pair of registration rollers 105 in a predetermined timing. Then, the transfer sheet passes along the transfer devices opposing the respective photoconductors 1M to 1BK, when toner images on the photoconductor drums 1M to 1BK formed by the image forming unit 111M to 111BK, respectively, are sequentially overlaid and transferred onto the transfer sheet to form a color toner image thereon. The color toner image formed on the transfer sheet is fixed by the fixing unit 107, and is discharged onto the sheet discharge tray 108.

Next, the development devices are described below in detail. Since the development devices 4M to 4BK share a configuration, though colors of developers contained therein are different, the suffixes M, C, Y, and BK representing the colors are omitted below. The development devices 4M to 4BK and the photoconductor drums 1M to 1BK are hereinafter referred to as the development device 4 and the photoconductor drum 1, respectively.

Figure 6:
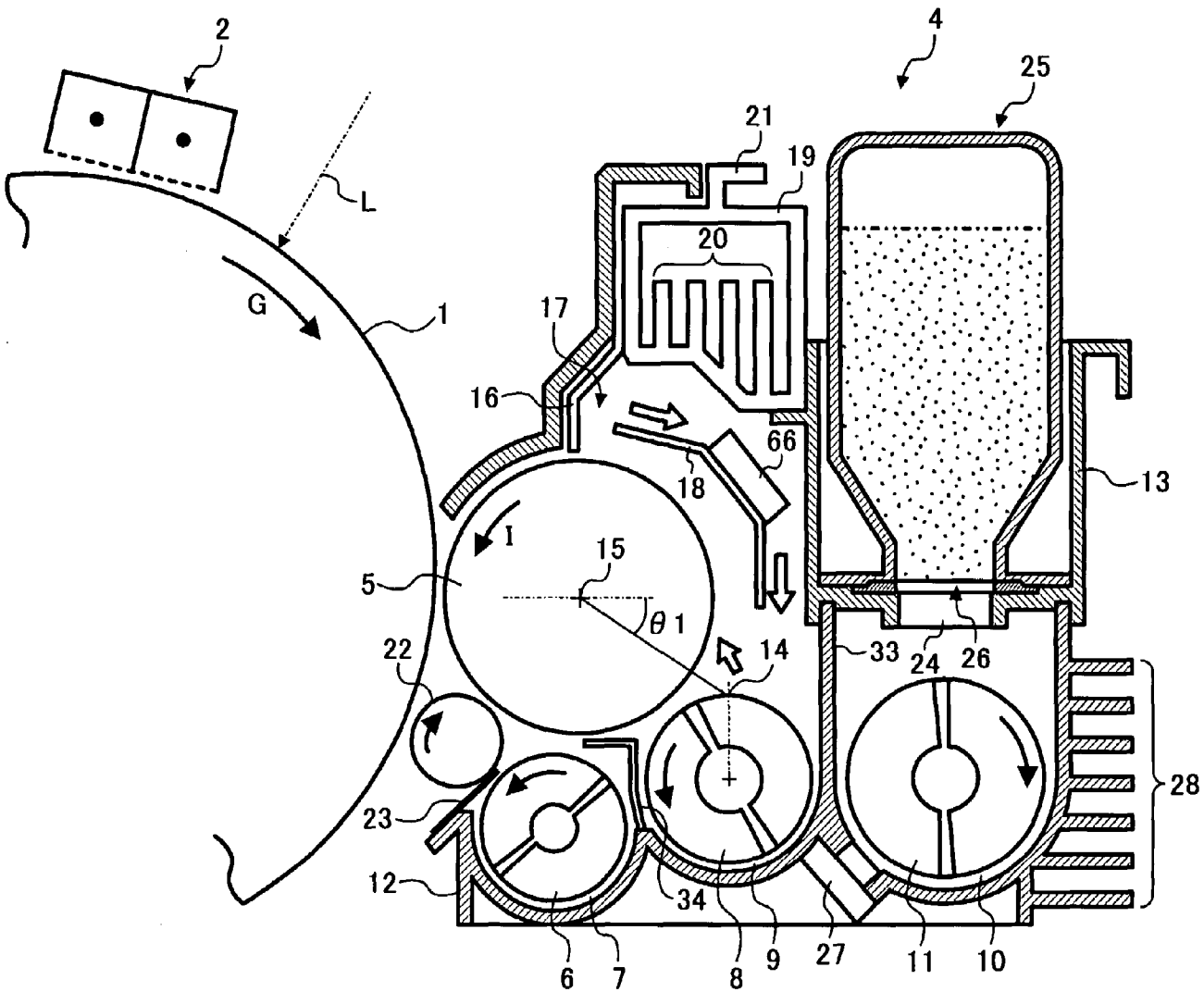
FIG. 6 is a schematic illustration of a configuration of a development device included in the printer shown in FIG. 5.

As shown in FIG. 6, the photoconductor drum 1 is provided with a charger 2 and the development device 4. The development device 4 includes a development roller 5, a collection and conveyance path 7 including a collection and conveyance auger 6, a supply and conveyance path 9 including a supply and conveyance auger 8, and an agitation and conveyance path 10 including an agitation and conveyance auger 11. The development device 4 further includes a doctor 16, a doctor area 17, a regulated developer collection member 18, a heat radiation member 19, a fin 20, a guide member 21, a developer trap roller 22, a scraper 23, an opening 24, a developer cartridge 25, a developer cartridge seal 26, a heat radiation fin 28, a partition wall 33, a partition plate 34, and an adjustment plate 66. The development device 4 further includes a toner concentration sensor 27, and a toner replenishment control device (not shown). The development device 4 has a casing including a lower casing 12 and an upper casing 13.

As shown in FIG. 6, the photoconductor drum 1 rotates in a direction of an arrow G. While the photoconductor drum 1 rotates, a surface of the photoconductor drum 1 is charged by the charger 2. The charged surface of the photoconductor drum 1 is irradiated with laser light L emitted from the optical writing unit 103 to form an electrostatic latent image. The photoconductor drum 1 is then supplied with toner by the development device 4 to develop the electrostatic latent image into a toner image.

The development roller 5 serves as a developer bearing member. While rotating in a direction of an arrow I, the development roller 5 supplies the toner onto the surface of the photoconductor drum 1 to develop the electrostatic latent image.

The supply and conveyance auger 8 serves as a developer supply and conveyance member. While supplying developer to the development roller 5, the supply and conveyance auger 8 conveys the developer in a backward direction in FIG. 6.

The development roller 5 is provided with the doctor 16 located downstream of a position facing the supply and conveyance auger 8 along the rotating direction I of the development roller 5. The doctor 16 serves as a developer regulation member for regulating the developer supplied to the development roller 5 to have a thickness suitable for development.

The collection and conveyance auger 6 is located downstream of a development position of the development roller 5 facing the photoconductor drum 1 along the rotating direction I of the development roller 5. The collection and conveyance auger 6 collects developer passed by the development position, and conveys the collected developer in the same direction as the supply and conveyance auger 8. The supply and conveyance path 9 serving as a developer supply and conveyance path and the collection and conveyance path 7 serving as a developer collection and conveyance path are arranged side by side below the development roller 5, and are partitioned by the partition plate 34 serving as a partition member. The partition plate 34 is provided with an opening at an end in the backward direction in FIG. 6 which is a downstream end in the conveyance direction of the collection and conveyance auger 6, connecting the supply and conveyance path 9 and the collection and conveyance path 7.

The agitation and conveyance path 10 serving as a developer agitation and conveyance path is located next to the supply and conveyance path 9 at an opposite side of the collection and conveyance path 7, and is arranged in parallel to the supply and conveyance path 9. The agitation and conveyance path 10 includes the agitation and conveyance auger 11 serving as a developer agitation and conveyance member configured to convey the developer in a frontward direction in FIG. 6 opposite to the conveyance direction of the supply and conveyance auger 8 while agitating the developer. The supply and conveyance path 9 and the agitation and conveyance path 10 are partitioned by the partition wall 33 serving as a partition member. The partition wall 33 is provided with an opening at each end in a longitudinal direction thereof, connecting the supply and conveyance path 9 and the agitation and conveyance path 10.

Consequently, the three paths, namely the collection and conveyance path 7, the supply and conveyance path 9, and the agitation and conveyance path 10, are connected in a transfer channel located at the end in the backward direction in FIG. 6.

Collected developer which has been conveyed by the collection and conveyance auger 6 to a downstream end of the conveyance direction thereof is transferred to the supply and conveyance path 9. Further, surplus developer which has been supplied into the supply and conveyance path 9 and conveyed to a downstream end of the conveyance direction thereof without having been used for development is, together with the collected developer, transferred into the agitation and conveyance path 10. Further, the toner replenishment control device supplies toner into the agitation and conveyance path 10 in the transfer channel according to an output signal from the toner concentration sensor 27 located at a lower portion of the agitation and conveyance path 10.

The collected developer, the surplus developer, and the toner are agitated by the agitation and conveyance auger 11 and conveyed in the agitation and conveyance path 10 in a direction opposite to the conveyance direction of the supply and conveyance auger 8. The agitated developer is transferred into an upstream side of the supply and conveyance path 9 through the opening arranged at the downstream end of the agitation and conveyance path 10.

The lower casing 12 and the upper casing 13 are formed in one piece. The lower casing 12 includes the partition plate 34 as a part thereof, and the upper casing 13 holds the partition wall 33 engaged with the lower casing 12.

As shown in FIG. 6, the supply and conveyance auger 8 is arranged so that an auger peak 14 which is a top portion thereof is located below a center 15 of rotation of the development roller 5. In the development device 4, an angle θ formed by a straight line drawn between the center 15 of rotation of the development roller 5 and the auger peak 14 with a horizontal line drawn on the center of the rotation 15 is set at 30 degrees. Although the angle θ depends on a diameter of the supply and conveyance auger 8, the angle θ is preferably between 10 to 40 degrees in a layout for reducing the size of the development device 4.

The developer is supplied to the development roller 5 through the action of a magnetic pole provided inside the development roller 5 which attracts a magnetic carrier in the developer. As described above, since the supply and conveyance auger 8 is arranged such that the auger peak 14 is located below the center 15 of rotation of the development roller 5, the weight of the developer does not affect an amount of developer to be supplied to the development roller 5, and the amount of developer to be supplied depends on force of magnetic attraction. Therefore, the developer being conveyed in the supply and conveyance path 9 is surely supplied from an upper portion thereof. As a result, even when a volume of developer inside the supply and conveyance path 9 varies along the conveyance direction of the supply and conveyance auger 8, a suitable amount of developer can be supplied to the development roller 5.

Figure 2:
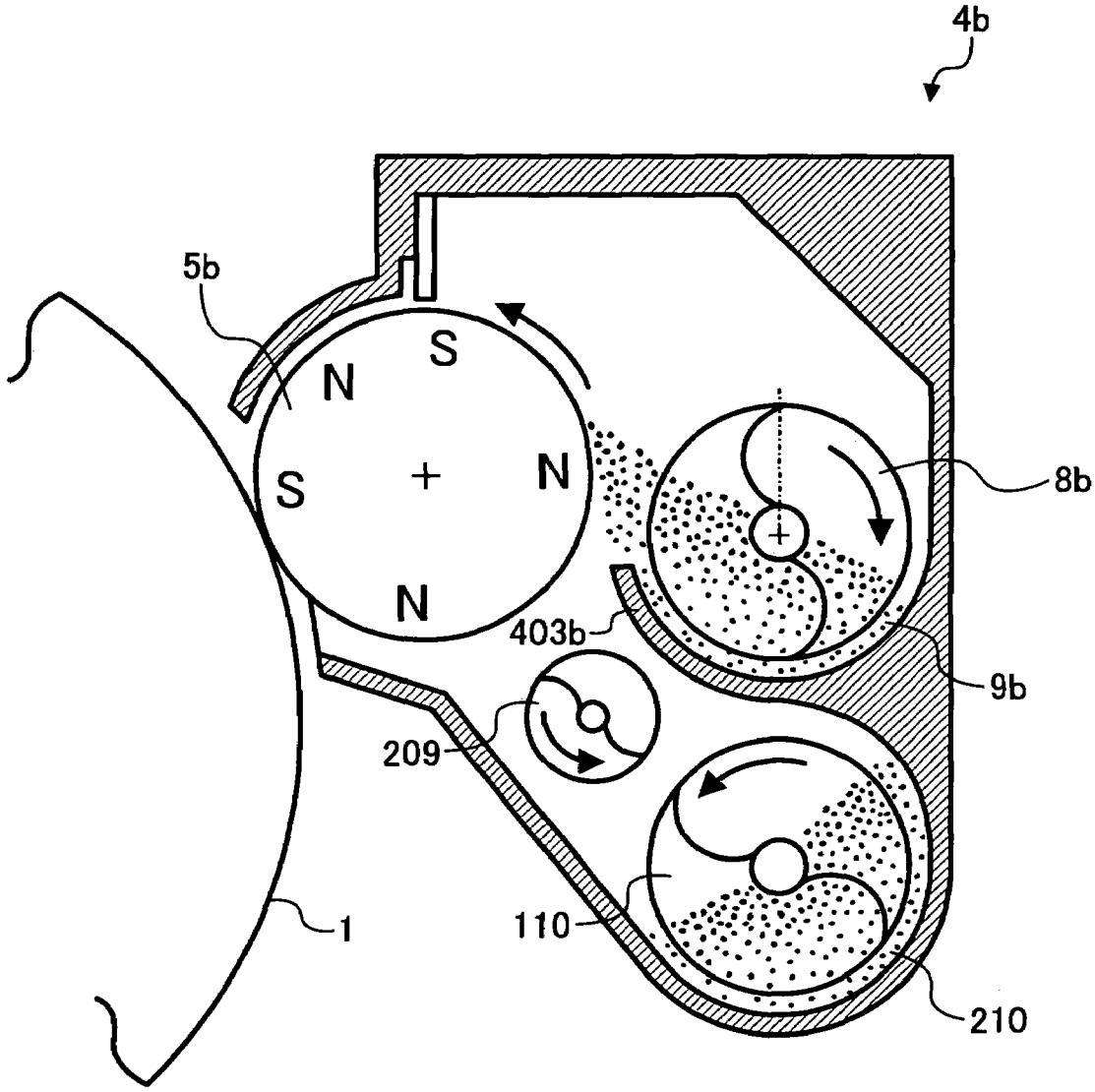
FIG. 2 BACKGROUND ART
FIG. 2 is a schematic illustration of a configuration of another background development device.
Figure 3:
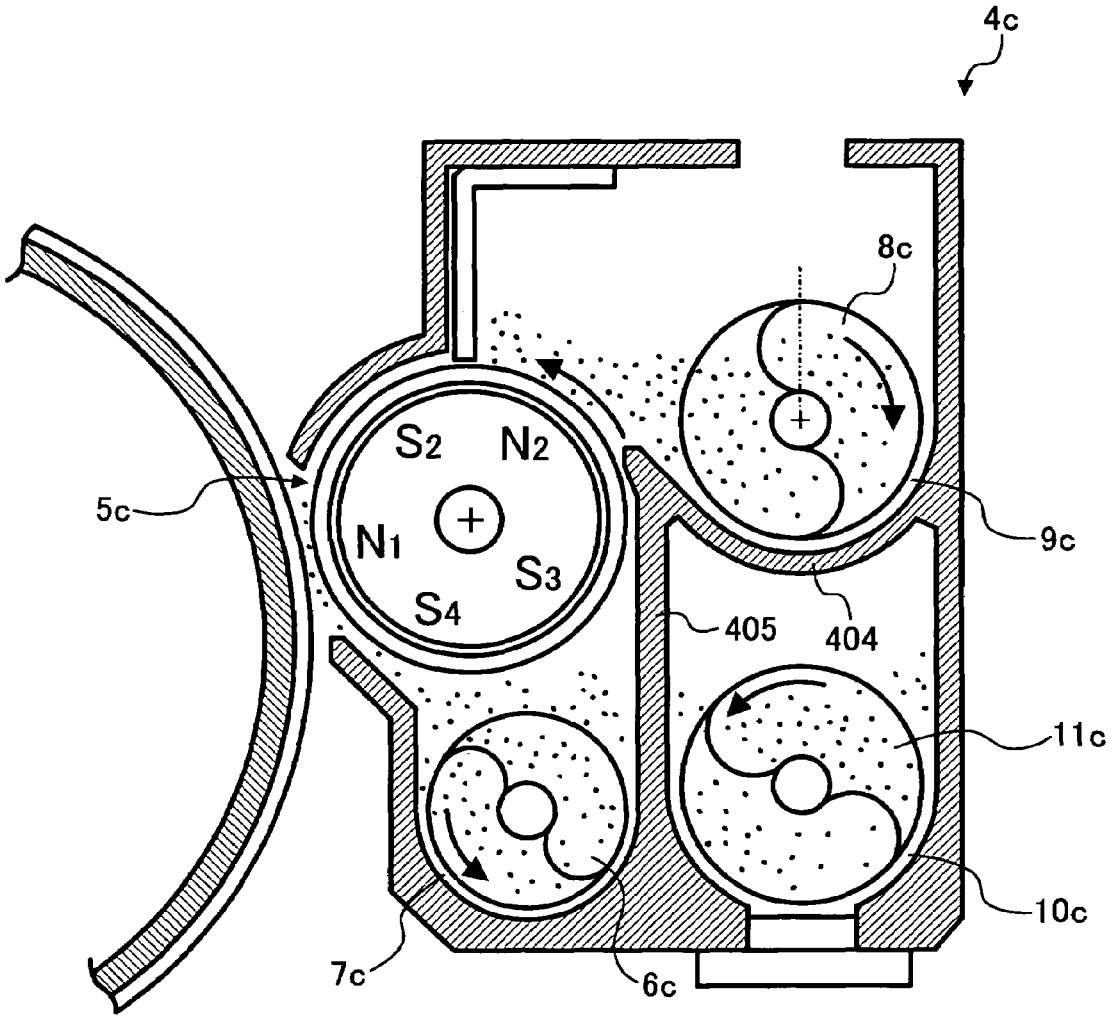
FIG. 3 BACKGROUND ART
FIG. 3 is a schematic illustration of a configuration of another background development device.
Figure 4:
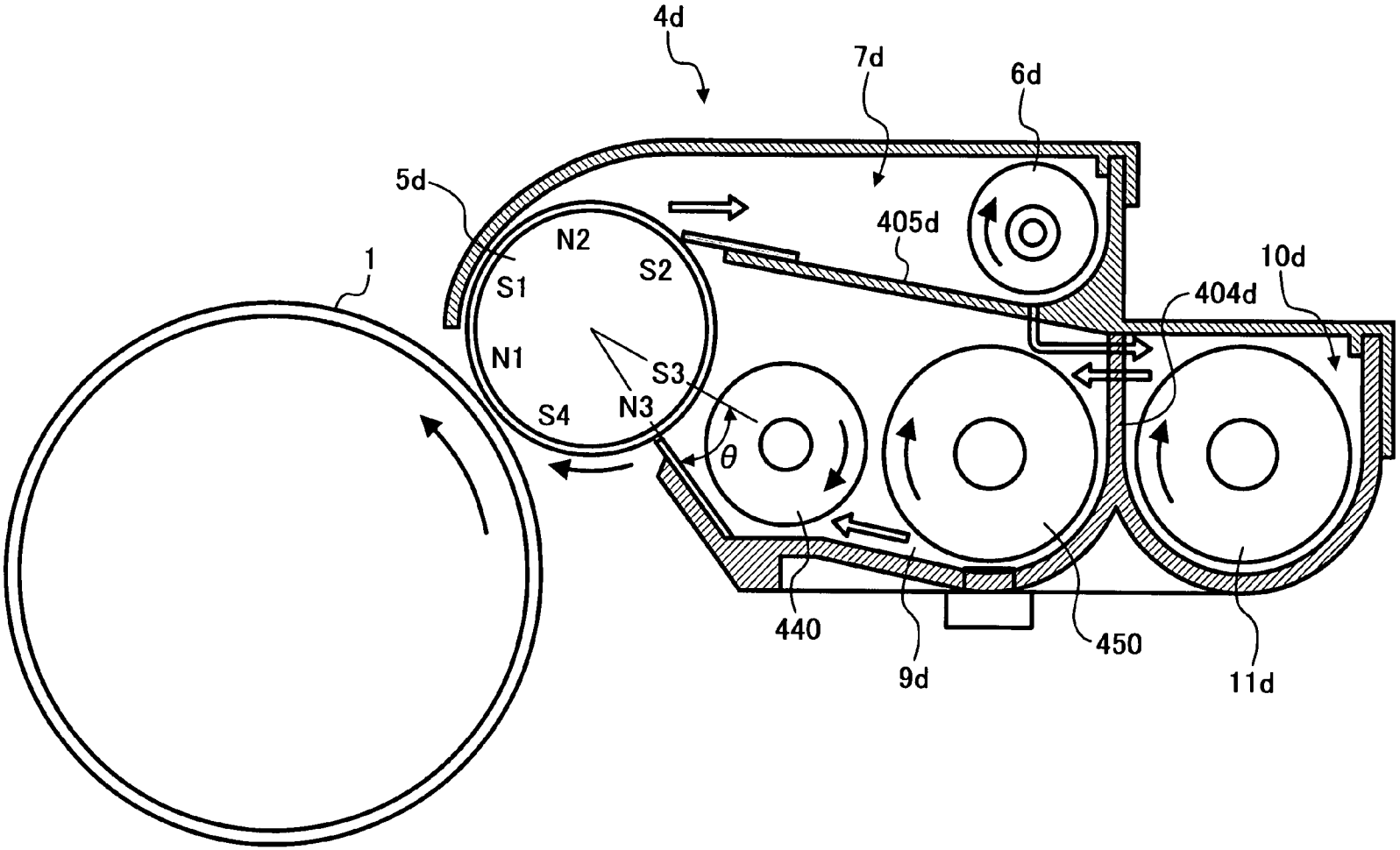
FIG. 4 BACKGROUND ART
FIG. 4 is a schematic illustration of a configuration of another background development device.

In a case of laterally supplying toner to a development roller as in development devices shown in FIGS. 2 and 3, the toner is supplied onto a surface of the development roller not only by magnetic force inside the development roller but also by the weight of developer. As a result, the developer is excessively supplied at an upstream side in a conveyance direction, and a large amount of developer is regulated by a doctor member, imposing unnecessary stress on the developer. On the other hand, when developer is supplied from beneath as described in the present invention, a development roller can be prevented from being provided with the developer by the weight of the developer. As the developer is supplied by magnetic force of the development roller instead, the developer is not unnecessarily regulated, and as a result, the developer can be prevented from undergoing unnecessary stress.

Figure 7:
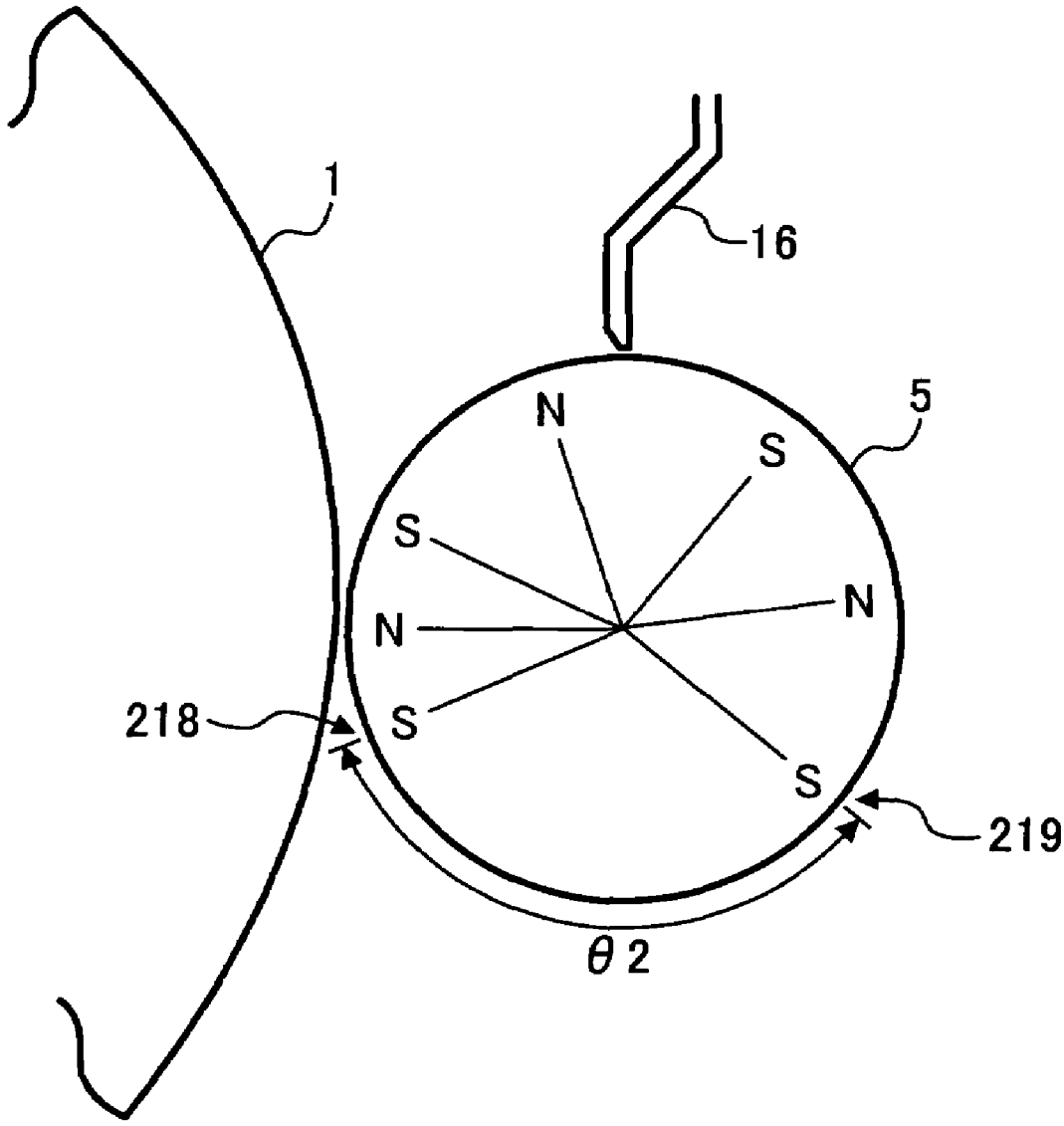
FIG. 7 is a schematic illustration for explaining an arrangement of magnetic poles in a development roller included in the development device shown in FIG. 6.

Next, an arrangement of magnetic poles in the development roller 5 is described below referring to FIG. 7. As shown in FIG. 7, the development roller 5 includes an S pole 218 arranged in the lowest reaches of a development area facing the photoconductor drum 1, and another S pole 219 for drawing the developer arranged at a position facing to the supply and conveyance auger 8. No magnetic pole is arranged in an area between the S poles 218 and 219. The area having no magnetic pole serves as a developer collection area for collecting developer which has been used for development. The collection and conveyance path 7 is arranged at a position facing to the developer collection area and right below the development roller 5. When the used developer is conveyed after passing through the development area to the developer collection area, the used developer is no longer influenced by magnetic force. The used developer falls into the collection and conveyance path 7 by centrifugal force and the weight of the used developer as the development roller 5 rotates, and is collected and conveyed as collected developer.

When collection of used developer is attempted at a position above a development roller, even when the position is not under the influence of the magnetic force, the developer is kept on a surface of the development roller due to its weight, and may cause the developer to be conveyed downstream as the surface of the development roller moves. When this phenomenon is applied to the used developer, the developer having a changed toner concentration is conveyed to a supply position, and is again to be used for development. As a result, a concentration of toner on the development roller may be reduced, and may be uneven.

In the development device 4 in FIG. 6, a developer collection area is arranged on a lower surface of the development roller 5, and the collection and conveyance path 7 is placed below the developer collection area. Therefore, the weight of the developer contributes to the collection of the developer. As a result, the developer can be more surely collected, and the used developer can be prevented from being conveyed downstream. Therefore, the toner concentration can be surely kept constant.

Further, the configuration of the development device 4 is such that, as shown in FIG. 6, the collection and conveyance path 7 and the collection and conveyance auger 6 are arranged substantially right below the development roller 5, and the supply and conveyance path 9 and the supply and conveyance auger 8 are arranged below the development roller 5 in a slanting direction. With this configuration, the S pole 218 in the lowest reaches of the development area and the S pole 219 for drawing the developer can be arranged with an increased distance.

In a case of a background apparatus, used developer is not separated from a development sleeve under the influence of a magnetic pole for drawing developer, and is caused to be conveyed downstream. As a result, in some cases, the used developer has been carried along by the development roller 5. The used developer being carried along by the development roller 5 causes a problem such that a reduced toner concentration and an uneven toner concentration prevent stable image forming.

On the other hand, in the development device 4, since the S pole 218 in the lowest reaches of the development area and the S pole 219 for drawing the developer are arranged with increased distance, the used developer is less likely to be affected by the S pole 219 for drawing the developer. As a result, the arrangement largely contributes to prevention of the above problem.

When the configuration is such that a supply mechanism is arranged above a development roller and a collection mechanism is arranged below the development roller, used developer is carried along into a side position of the development roller, requiring a magnetic pole for conveying the developer. As a result, a magnetic pole for drawing developer and another magnetic pole arranged upstream of the magnetic pole have a small interval, and a problem of carrying along the developer is likely to be caused. In the development device 4, the S pole 219 for drawing the developer arranged on the development roller 5 forms an angle $\theta_2$ of 113 degrees with the S pole 218 arranged downstream in the rotating direction for development, in other words, arranged upstream of the S pole 219.

In a background development device, an angle a magnetic pole for drawing developer arranged on a development roller forms with another magnetic pole arranged upstream thereof is not greater than 90 degrees. The angle $\theta_2$ in the development device 4 is more than 20 degrees larger (approximately 25% more) than the angle in the background development device. When an interval between a magnetic pole for drawing developer and another magnetic pole arranged upstream thereof is increased, the phenomenon of carrying along the used developer is less likely to be caused. Although the angle $\theta_2$ in the development device 4 is 113 degrees, a value of the angle $\theta_2$ is not limited thereto. When the value of the angle $\theta_2$ is larger than the corresponding angle in the background development device, which is, for example, 100 degrees or more, the problem related to a toner concentration attributed to the phenomenon of carrying along the used developer can be more certainly avoided.

In the development device 4, since the development roller 5 has three magnetic poles for development, and one of the three magnetic poles for development arranged at the downstream end also serves as a magnetic pole for conveying developer, a dedicated magnetic pole for conveyance is not needed.

When the developer is supplied onto the surface of the development roller 5, the developer is regulated by the doctor 16 to have an optimum layer thickness for development. As the developer needs to be regulated by the doctor 16 to have the optimum layer thickness for development, an amount of the developer supplied to the development roller 5 is larger than an amount of developer passing by the doctor 16. Therefore, the developer is constantly regulated by the doctor 16. As a result, the regulated developer accumulates in the doctor area 17 located upstream of the doctor 16 as the development device 4 performs development.

The regulated developer is subsequently supplied to the development roller 5, and is raised by developer subsequently brought to the doctor area 17. Then the developer falls onto the development roller 5, and is again supplied to the doctor area 17. The developer is thereby circulated.

The regulated developer collection member 18 causes the regulated developer accumulated in the doctor area 17 to bypass and flow back into the supply and conveyance path 9 when an amount of the regulated developer exceeds a predetermined level to avoid circulated convection of the regulated developer. Further, a position of the regulated developer collection member 18 is determined so as to prevent the reflowing developer from residing due to an influence of magnetic force of the development roller 5.

The doctor 16 is fixed to the heat radiation member 19 in contact with the heat radiation member 19 fixed to the upper casing 13. The doctor 16 transmits heat from the developer to the heat radiation member 19. The fins 20 formed inside the heat radiation member 19 radiate the heat by using airflow during operation so that a temperature of the developer does not increase. Further, the heat radiation member 19 includes the guide member 21 serving as a guide when a selected one of the development device 4 and the image forming unit 111 is attached to and detached from the printer 100.

The lower casing 12 is provided with the heat radiation fins 28 so that an increase in temperature is reduced and the entire development device 4 is cooled down by cool air sent from a front area of the printer 100 to a rear area thereof.

The developer trap roller 22 is located downstream in the rotating direction of the development roller 5. Developer attached to the photoconductor drum 1 and developer fallen from the development roller 5 are caught by the developer trap roller 22. The developer trap roller 22 rotates in reverse of the development roller 5 so that a part of the caught developer is returned to the development roller 5, and the rest is collected by the scraper 23 and put back into the collection and conveyance path 7.

The upper casing 13 is provided with the opening 24 arranged above the agitation and conveyance auger 11 and the agitation and conveyance path 10 to hold the developer cartridge 25. When the printer 100 is delivered, and after the developer cartridge 25 is pulled out for replacement of the developer, the developer cartridge 25 needs to be set. After the developer cartridge 25 is set, when the developer cartridge seal 26 is removed, developer is inserted through the opening 24 so that the development device 4 is replenished with the developer. Since the developer is supplied in a cartridge, replacement thereof can be easily performed.

Next, circulation of the developer in the three conveyance paths is described below.

Figure 8:
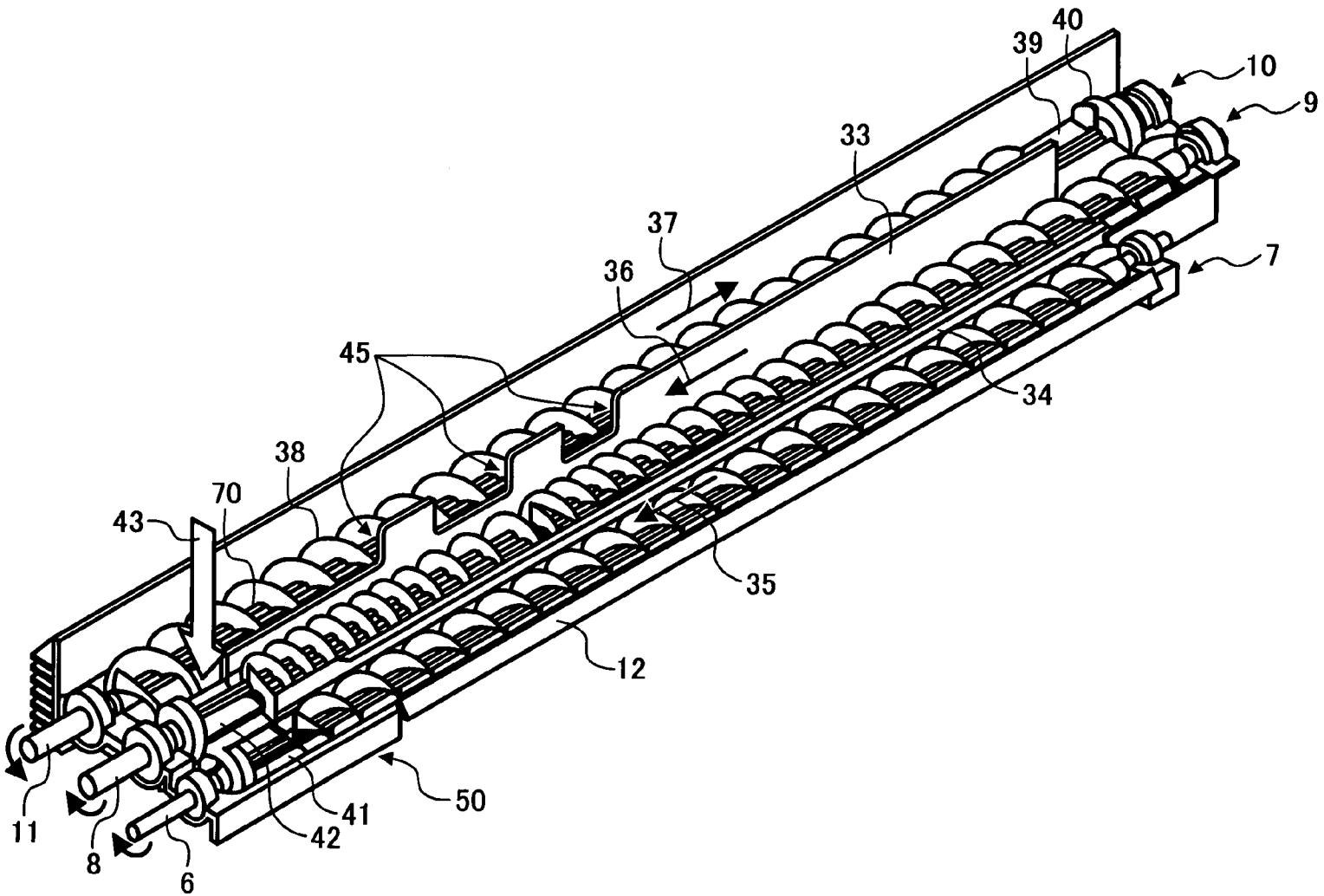
FIG. 8 is a perspective view of a lower casing of the development device shown in FIG. 6.

FIG. 8 is a perspective view of the lower casing 12 including the conveyance paths and augers in the development device 4 with the upper casing 13 removed, viewed from a side of the photoconductor drum 1.

The lower casing 12 is provided with the collection and conveyance auger 6, the supply and conveyance auger 8, and the agitation and conveyance auger 11 arranged in the order from a front side in FIG. 8. The conveyance paths are formed so as to separate respective conveyance areas of the corresponding augers. The supply and conveyance path 9 and the collection and conveyance path 7 are supported by the upper casing 13, and are divided by the partition plate 34 engaged with the lower casing 12. The collection and conveyance auger 6 and the supply and conveyance auger 8 convey developer in directions of arrows 35 and 36, respectively, which are backward directions in FIG. 8. On the other hand, the agitation and conveyance auger 11 conveys developer in a direction of an arrow 37, opposite to the directions of the arrows 35 and 36, which is a frontward direction in FIG. 8.

A configuration of the agitation and conveyance auger 11 is described below as an exemplary configuration of the augers according to the embodiment of the present invention. The collection and conveyance auger 6 and the supply and conveyance auger 8 have the same configurations as the configuration of the agitation and conveyance auger 11.

The agitation and conveyance auger 11 includes a shaft 70 having an agitation and conveyance thread 38, a transverse paddle 39, and a reverse thread 40. The collection and conveyance auger 6 includes a transverse paddle 41. The supply and conveyance auger 8 includes a transverse paddle 42.

The agitation and conveyance thread 38 agitates and conveys the developer in the conveyance direction of the agitation and conveyance auger 11. The transverse paddle 39 transfers the developer toward the neighboring supply and conveyance auger 8. The reverse thread 40 has a thread winding in reverse of the agitation and conveyance thread 38, and causes developer at the downstream end in the conveyance direction in the agitation and conveyance path 10 to be conveyed in a direction opposite to the conveyance direction so that the developer is not sent to a bearing portion located at the downstream end in the conveyance direction.

The partition wall 33 is provided with an opening at the downstream end in the conveyance direction in the agitation and conveyance path 10, connecting a downstream end area of the agitation and conveyance path 10 and an upstream end area of the supply and conveyance path 9. When the developer is conveyed to the downstream end in the agitation and conveyance path 10, the developer is transferred by the transverse paddle 39 of the agitation and conveyance auger 11 into the upstream end area of the supply and conveyance path 9.

On the other hand, at an end opposite to the opening, each of the partition wall 33 and the partition plate 34 is provided with another opening, connecting a downstream end area of the collection and conveyance path 7, a downstream end area of the supply and conveyance path 9, and an upstream end area of the agitation and conveyance path 10 to form a connection part 50. The collected developer in the collection and conveyance path 7 is transferred into the supply and conveyance path 9 by the transverse paddle 41 of the collection and conveyance auger 6. The collected developer transferred from the collection and conveyance path 7 is mixed with surplus developer having been conveyed to the downstream end in the supply and conveyance path 9. The surplus developer and the collected developer are transferred into the agitation and collection path 10 by the transverse paddle 42 of the supply and conveyance auger 8.

As shown in FIG. 8, the partition wall 33 formed on the lower casing 12 to divide the agitation and conveyance path 10 and the supply and conveyance path 9 is provided with a plurality of volume adjustment openings 45 arranged downstream of the center of a development area of the supply and conveyance auger 8.

In case the rotation of the development roller 5 is stopped, and in case an amount of developer used for development is decreased due to a setting of the doctor 16, a volume of the developer residing in the supply and conveyance path 9 may exceed a desired level. When the volume of the developer exceeds the desired level, conveyance efficiency of the supply and conveyance auger 8 is significantly lowered, and normal developer circulation cannot be maintained. As a result, the developer may be partially degraded.

In the development device 4 according to the present invention, when the volume of the developer in the supply and conveyance path 9 exceeds a desired level after the developer flows beyond the center thereof, the developer overflows from the volume adjustment openings 45 into the agitation and conveyance path 10. Thus, the volume of the developer in the supply and conveyance path 9 is controlled.

The developer in the supply and conveyance path 9 is developer having not been used for development, and a toner concentration thereof is suitable for development. Therefore, the flowing of the developer into the agitation and conveyance path 10 does not cause a reduction in the toner concentration, and does not result in an unevenness of the toner concentration.

Although the development device 4 is provided with the plurality of volume adjustment openings 45 as shown in FIG. 8, only one volume adjustment opening 45 may be arranged, instead, downstream of the center of the development area of the supply and conveyance auger 8.

With the configuration in which the volume adjustment openings 45 are arranged at higher positions than a predetermined level on the partition wall 33 so that the excessive developer in the supply and conveyance path 9 overflows into the agitation and conveyance path 10, the overflow can be achieved because the supply and conveyance path 9 and the agitation and conveyance path 10 are arranged at the substantially same level. When, for example, the supply and conveyance path 9 is arranged at a lower position than the agitation and conveyance path 10, the developer cannot be supplied to the agitation and conveyance path 10 even when the developer in the supply and conveyance path 9 overflows. When the supply and conveyance path 9 is arranged at a higher position than the agitation and conveyance path 10, on the other hand, another path is required for the overflowed developer to drop into the agitation and conveyance path 10, resulting in a complex configuration.

Figure 9:
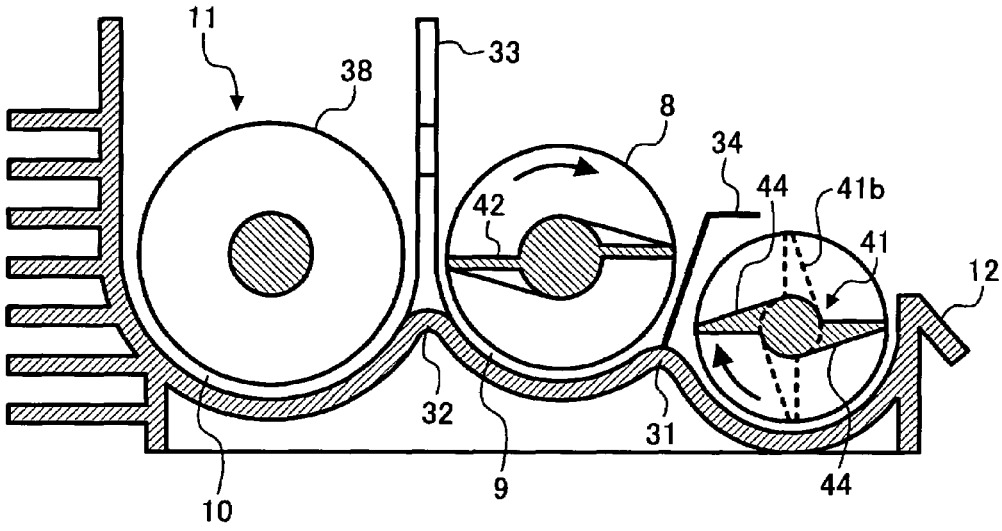
FIG. 9 is a schematic cross-section view of a transfer channel where three conveyance paths are connected.

Next, a transfer channel of the developer where the three conveyance paths, namely the collection and conveyance path 7, the supply and conveyance path 9, and the agitation and conveyance path 10, are connected as shown in FIG. 8 is described below referring to FIG. 9. The transfer channel is located at the downstream ends of the collection and conveyance path 7 and the supply and conveyance path 9, and at the upstream end of the agitation and conveyance path 10.

As described above, the partition wall 33 and the partition plate 34 are provided with the openings for transferring the developer. The developer is transversely transferred by the rotating paddles arranged in the collection and conveyance path 7, the supply and collection path 9, and the agitation and conveyance path 10. When flat bottom surfaces of conveyance paths are connected, the conveyance paths have dead points with respect to the rotating paddles, resulting in failed transferring. Therefore, the three conveyance paths in the development device 4 are provided with a convex part 31 between the collection and conveyance path 7 and the supply and conveyance path 9, and a convex part 32 between the supply and conveyance path 9 and the agitation and conveyance path 10 so that developer does not return once the developer is transferred over each of the convex parts.

Since the transverse paddle 41 need to transfer the developer relatively upward, extrusion surfaces 44 thereof are inclined so that the developer can be extruded further outward. The number of paddle blades is not limited to two, and may be increased as indicated by a dotted line 41*b* according to an amount of the developer to be conveyed.

Since the transverse paddle 42 in the supply and conveyance path 9 located in the middle of the three conveyance paths needs to draw in collected developer transferred therein, and to extrude the developer to the agitation and conveyance path 10, the transverse paddle 42 has substantially flat blades different from the transverse paddle 41.

The toner concentration sensor 27 arranged in the lower casing 12 is located below the agitation and conveyance auger 11. The toner replenishment unit (not shown) includes a control system replenishes toner according to an output signal from the toner concentration sensor 27. As shown in FIG. 8, the toner is put in a position 43 in the transfer channel located between the supply and conveyance auger 8 and the agitation and conveyance auger 11 from an upper part. Since the position 43 is located where the transverse paddle 42 rakes up the developer to transversely transfer the developer, the developer therein is strongly agitated, and as a result, the added toner is agitated and mixed with the developer in a short time. The location where the toner is put is not limited to the position 43 between the supply and conveyance auger 8 and the agitation and conveyance auger 11, and the location may be between the collection and conveyance auger 6 and the supply and conveyance auger 8.

As described above the developer is circulated in the development device 4 by using the collection and conveyance auger 6, the supply and conveyance auger 8, and the agitation and conveyance auger 11 arranged in a tier, and the collection and conveyance path 7, the supply and conveyance path 9, and the agitation and conveyance path 10 arranged in another tier, with both tiers located below the development roller 5. Since the developer is transversely transferred between the conveyance paths, the developer need not to be brought upward in the circulation. As a result, stress otherwise imposed on developer during circulation can be avoided, and life of the developer can be prolonged.

Further, the three conveyance paths are connected. As a result, the collected developer and the surplus developer can be transferred into the agitation and conveyance path 10 with a simplified configuration.

In a background development device, developer is transferred into an adjoining conveyance path through an opening by being extruded only by conveyance force working in a direction parallel to a conveyance direction in the path even at a downstream end in the conveyance direction. With such a configuration, since the developer is under pressure for being extruded through the opening, the developer is subjected to excessive stress, resulting in shortened life. On the other hand, the development device 4 according to the embodiment of the present invention is provided with a member in a paddle shape in the conveyance path for giving conveyance force in the transverse direction at the downstream end in the conveyance direction. As a result, the developer can be transferred without such pressure as with the configuration of the background development device, and the stress otherwise imposed on the developer can be reduced.

Figure 10:
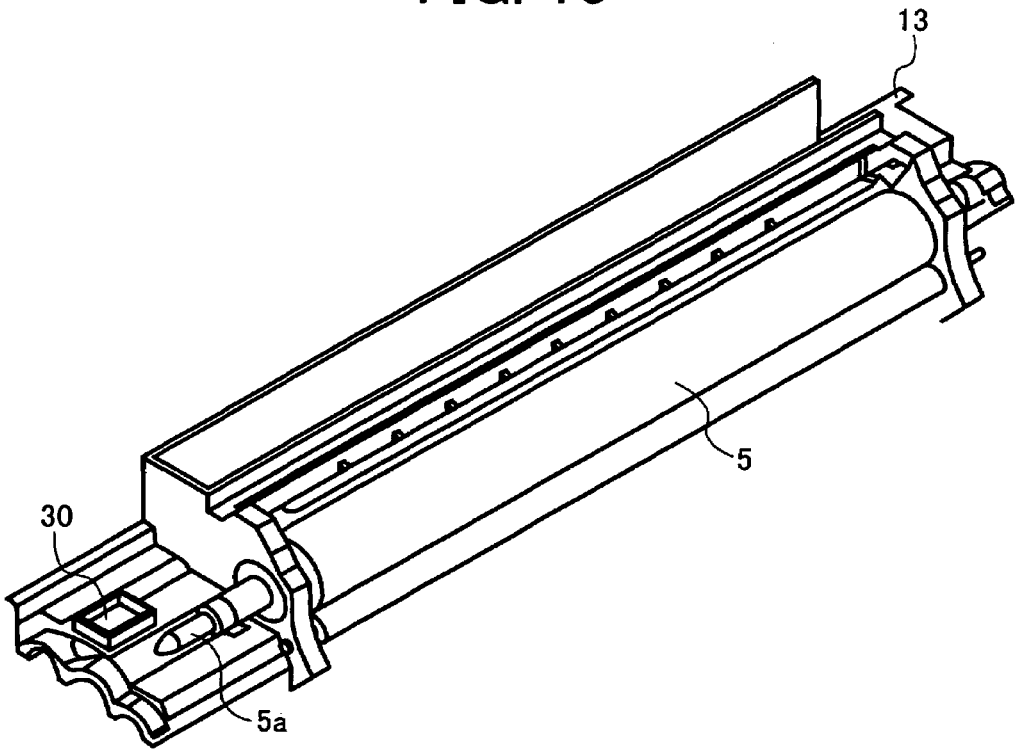
FIG. 10 is a perspective view of an upper casing of the development device shown in FIG. 6.

FIG. 10 is a perspective view of the upper casing 13 of the development device 4 with the development roller 5 attached.

As shown in FIG. 10, a toner replenishment opening 30 for passing toner supplied from the toner replenishment unit (not shown) is disposed outside a development area in an axial direction of the conveyance augers. The toner supplied from the toner replenishment unit is put through the toner replenishment opening 30 into the position 43 shown in FIG. 8.

As shown in FIG. 10, a roller shaft 5*a* of the development roller 5 is extended over a part of the transfer channel located between the collection and conveyance path 7 and the supply and conveyance path 9. In the development device 4, the toner replenishment opening 30 cannot be arranged over the part of the transfer channel as a drive unit (not shown) of the roller shaft 5*a* is located there. When the arrangement is not restricted by the location of the drive unit, the toner replenishment opening 30 may be arranged over the part of the transfer channel. In the case, toner can be added to the collected developer having a lowered toner concentration, and as a result, agitation of the developer can be more efficiently performed.

Next, a relationship between amounts of developer (per unit of time) conveyed in the agitation and conveyance path 10, the supply and conveyance path 9, and the collection and conveyance path 7 is described below referring to FIG. 11.

Figure 11:
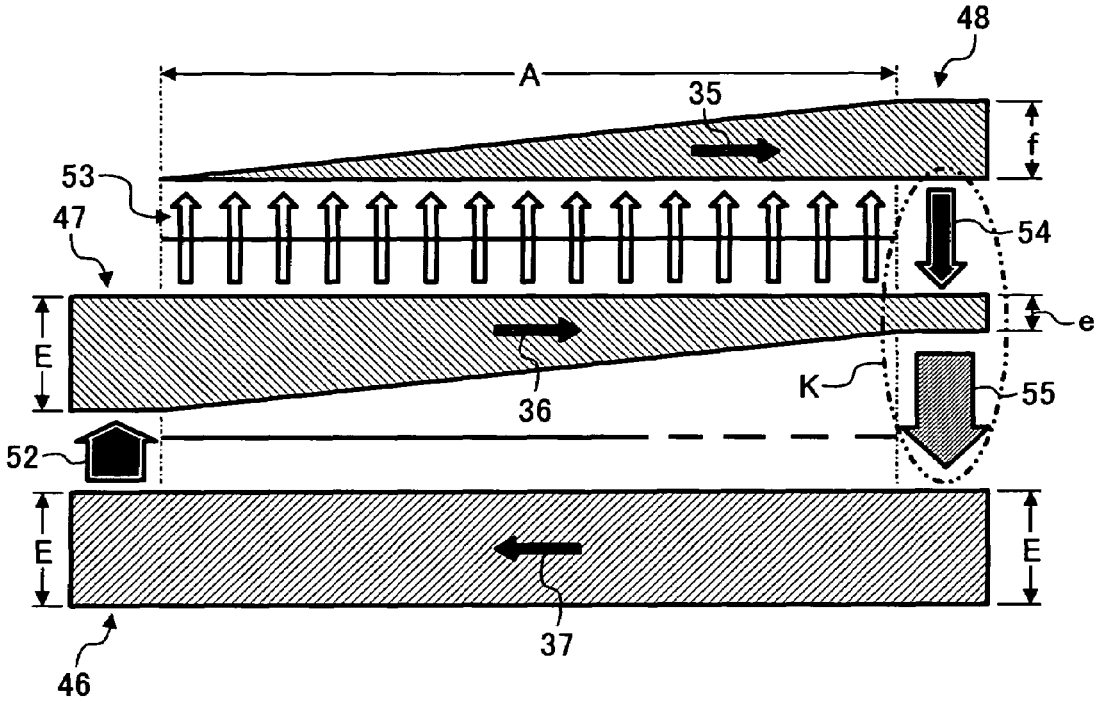
FIG. 11 is a schematic illustration for explaining amounts of developer conveyed in the three conveyance paths and a flow of the developer in the development device.

A transverse direction in FIG. 11 represents a depth direction of the printer 100, in other words, the conveyance directions of the augers in the development device 4.

A shaded area 46 represents an amount of developer conveyed in the agitation and conveyance path 10. A shaded area 47 represents an amount of developer conveyed in the supply and conveyance path 9. A shaded area 48 represents an amount of developer conveyed in the collection and conveyance path 7. The developer is conveyed in directions of the arrows 35, 36, and 37 in the collection and conveyance path 7, the supply and conveyance path 9, and the agitation and conveyance path 10, respectively. A width at any point of the shaded areas relative to the conveyance directions represents the amount of developer present at the point.

As indicated by an arrow 52, the developer in the agitation and conveyance path 10 is transferred into the supply and conveyance path 9 at the downstream end in the conveyance direction. Arrows 53 indicates that, within the development area of the development roller 5, the developer in the supply and conveyance path 9 is sequentially transferred into the collection and conveyance path 7 through the development roller 5. Therefore, the developer in the supply and conveyance path 9 diminishes in the development area, while the developer in the collection and conveyance path 7 increases in proportion to a diminished amount. As indicated by an arrow 54, the developer in the collection and conveyance path 7 is transferred into the supply and conveyance path 9 at the downstream end in the conveyance direction. Then, as indicated by an arrow 55, the transferred developer is further transferred, together with the developer in the supply and conveyance path 9, into the agitation and conveyance path 10. The transverse transferring of the developer is carried out within an area K through the connection part 50 shown in FIG. 8.

For the developer to be smoothly circulated, the conveyance capacity of each set of the augers and paths needs to satisfy the following equation:

$$E=e+f,$$

where f represents an output of the collection and conveyance auger 6, e represents an output of the supply and conveyance auger 8, and E represents an input of the agitation and conveyance auger 11.

Further, an output of the agitation and conveyance auger 11 is equal to an input of the supply and conveyance auger 8, which is also equal to the input E of the agitation and conveyance auger 11.

For the developer to be stably supplied, the amount of developer conveyed by the supply and conveyance auger 8 in the supply and conveyance path 9 needs to include a margin. A filling factor (volume) of the developer in the supply and conveyance path 9 and conveyance efficiency of the supply and conveyance auger 8 are important factors. The volume of the developer is not even throughout the supply and conveyance path 9, and tilted in an agitation direction. Further, since the conveyance efficiency varies depending on lead, material, thickness of the auger thread, and the number thereof, the amount of the developer needs to include a margin. When the margin is set as ±10%, and an amount of developer surely overflows is set as 10%, the output e is preferably larger than E/5 so that the output e accounts for 20% or more of the input E which is the amount of developer transferred from the agitation and conveyance path 10.

When the output e approaches the input E, an increasing amount of developer is unnecessarily conveyed, thereby imposing extra stress on the developer. An amount of developer supplied into the development area of the development roller 5 is determined by the doctor 16, which determines the amount of developer to be collected. In other words, the output f is determined by an amount of developer passing by the doctor 16. Therefore, the approaching of the output e toward the input E means that an amount of surplus developer simply increases relative to the amount of supplied developer, resulting in unnecessary agitation and conveyance, and in extra stress on the developer. Further, when the surplus developer increases, a ratio of the amount of developer collected after having been used to the amount of surplus developer falls. As a result, sensitivity of the toner concentration sensor 27 to a shift in toner concentrations is reduced, thereby causing difficulty in controlling the toner concentration.

The development device 4 according to the embodiment of the present invention is designed so as to satisfy the following relationship:

$$(E/3)>e>(E/4) \qquad \text{[Expression 1]}$$

From a viewpoint of the conveyance efficiency of the developer, the output e being the amount of surplus developer ideally decreases toward zero. However, a margin is needed for the development roller 5 to be surely supplied with a constant amount of developer. The sensitivity of the toner concentration sensor 27 located at the upstream side in the conveyance direction of the agitation and conveyance path 10 largely depends on the ratio of the amount of collected developer to the amount of surplus developer. In other words, when the ratio of the amount of collected developer is large, toner is supplied to make the toner concentration even throughout the path, which depends on agitation capability. When a ratio of the amount of surplus developer is raised, the collected developer is provided with newly supplied toner and with toner included in the surplus developer. As a result, large inconsistencies in the toner concentration can be avoided.

According to the above points, the output e satisfies the relationship of expression 1 so that the conveyance efficiency of the developer can be secured (with lowered stress on the developer), and the toner concentration can be controlled (with excellent sensitivity of the toner concentration sensor 27 and a consistent toner concentration).

Next, a relationship between various conditions of the augers and conveyance capacity thereof (a rough calculation method) is described below.

As the three augers share the same cross-sectional profile, both vertically and longitudinally, an auger in a singular form hereinafter refers to the three augers.

Figure 12A:
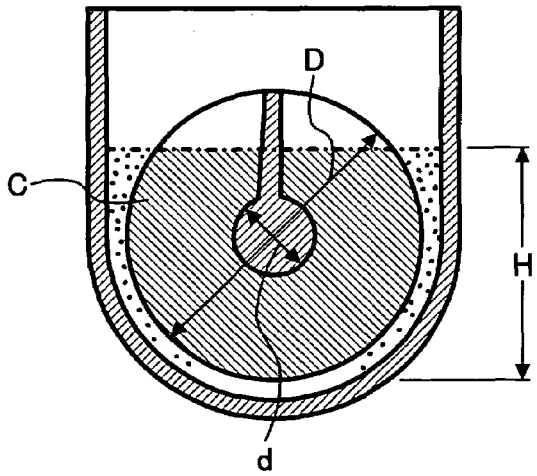
FIG. 12A is a vertical section view of an auger according to the embodiment of the present invention.
Figure 12B:
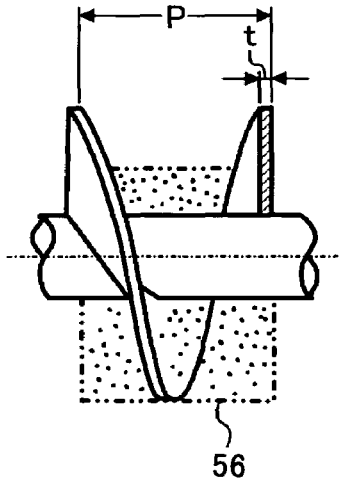
FIG. 12B is a longitudinal section view of the auger shown in FIG. 12A.

FIGS. 12A and 12B are vertical and longitudinal section views of the auger, respectively.

In FIG. 12A, reference numerals D, d, H, and C represent a diameter of the auger [mm], a diameter of a shaft of the auger [mm], a height of the auger buried in the developer from a bottom of the auger [mm], and an area [$mm^2$] of the developer to which conveyance force of the auger is transmitted, respectively. The area C of the developer is expressed by the following functional formula (wherein a section area of the auger cross section is omitted):

$$C=f(D,d,H)\ [\mathrm{mm}^2]$$

When the height H is larger than the auger diameter D, the auger thread is completely buried in the developer, and developer in an upper portion is less likely to be brought downstream for agitation. Therefore, in consideration of agitation performance, the height H is at least 0.9 D or less, and is generally 0.5 D to 0.8 D.

In FIG. 12B, when reference numerals P and t represent a lead width [mm] and an average thickness [mm] of the auger thread, respectively, an amount of developer conveyed by a revolution of the auger is represented by a range 56 enclosed with chain double-dashed lines.

When Q [g/sec] represents an amount of developer conveyed by the auger, the following expression 2 holds true:

$$Q\ [\mathrm{g/sec}]=(\eta/102)*(\rho/103)*C*(P-j*t)*(n/60),$$

where η represents conveyance efficiency [%] (generally 50% to 80%, depending on a surface property, a lead angle, and so forth of the auger thread), ρ represents volume density of the developer [g/cm$^3$], j and n represent the number of threads and revolutions [rpm] of the auger, respectively.

The amounts of developer conveyed by the agitation and conveyance auger 11 and the collection and conveyance auger 6 are designed by using the input E and the output f, respectively, shown in FIG. 11 as reference amounts. The amount Q of the collection and conveyance auger 6 approaches the output f from 0. Therefore, when the conveyance efficiency, the volume density, the auger diameter, the auger shaft diameter, the lead width, the number of auger threads, and the number of revolutions are constant, for approximation, a required amount of developer can be secured as the area C shifts from 0. In other words, the height H shifts from 0. In the case, there is no problem in performance.

On the other hand, the amount Q of the supply and conveyance auger 8 shifts from E toward e as shown in FIG. 11. When the conveyance efficiency, the volume density, the auger diameter, the auger shaft diameter, the lead width, the number of auger threads, and the number of revolution are constant as in the case of the collection and conveyance auger 6, the height H shifts from H toward h (H>h). In the development device 4 according to the embodiment of the present invention, it is important that an adequate amount of developer be supplied to the development roller 5, and the developer on the upper surface thereof in the supply and conveyance path 9 is stably supplied from the upper surface so that the adequate amount of developer can be supplied to the development roller 5.

In order for the developer to have a height within a predetermined range to convey a constant amount of developer, a greater amount of developer than required needs to be conveyed, thereby resulting in excessive stress imposed on the developer, and shortened life of the developer.

Therefore, the height of developer needs to be stabilized at a constant level with slight fluctuations. For the reason, the supply and conveyance auger 8 cannot be designed to be the same as the collection and conveyance auger 6.

In order for the supply and conveyance auger 8 to have a constant value of the height H, the height H being constant causes the area C to be constant. When the conveyance efficiency, the volume density, the auger diameter, the auger shaft diameter, and the number of revolutions are constant, for approximation, in order for the amount Q to be the input E approaching the output e, the term related to the lead width, (P−j*t), needs to be shifted.

When P1 represents the lead width P to satisfy the equation, Q=E, and Pn represents the lead width Pn to satisfy the equation, Q=e, the following expressions based on expression 2 hold true:

$$E=K*(P1-j*t),\ \text{and}$$

$$e=K*(Pn-j*t),$$

where K=(η/102)*(p/103)*C*(n/60)

Further, when the thickness t of the auger thread is ignored as a value of the thickness is significantly small relative to the lead width P (j*t≈0), and 0 is assigned to j*t, expression 1 is expressed as follows:

$$(K*P1/3)>K*Pn>(K*P1/4),$$

resulting in the following relationship:

$$P1/3>PN>P1/4$$

In other words, when the lead width P is shifted from the initial lead width P1 to a range between 1/3 and 1/4, the height H can be maintained within a constant range.

Next, the consideration of an outside diameter of the auger, a lead angle, and so forth is described below.

It is known that conveyance efficiency greatly depends on a lead angle. When δ represents a lead angle, lateral force which contributes to an agitation property is referred to as sin δ, and traveling force is referred to as cos δ. For a good agitation property, the auger is provided with a background mechanism such as a paddle. As the present invention places an importance on the conveyance efficiency, the development device 4 according to the embodiment is designed with the lead angle smaller than 30 degrees (cos 30°=0.866) so that a loss due to the lead angle is smaller than 15%.

$$\delta=\tan-1(P/\pi*D),$$

where P represents the lead width, and D represents the auger diameter.

It is known that an increase in the number of the auger threads improves the conveyance efficiency. However, from a viewpoint of molding and processing thereof, providing two threads is considered as an upper limit. In the case, a changeover between a double-thread section and a single-thread section needs to be examined.

Although the above approximation is performed as j*t is nearly equal to 0, j*t (the number of the auger threads multiplied by the thickness of the auger thread) cannot be ignored when the lead width is small. When an improvement in efficiency attributed to the use of a double-thread auger is assumed as approximately 10% at maximum, there is no use increasing the number of the auger threads when a difference in values of (P−j*t) between the double-thread auger and a single-thread auger is not greater than 15%. In other words, when (P−2*t)/(P−t) is not smaller than 0.9, the use of the double-thread auger is effective.

$$(P-2*t)/(P-t)\geqq 0.9$$

$$\therefore P\geqq 11t$$

Therefore, when the average thickness of the auger thread is 2 [mm], the use of the double-thread auger is effective when P is not smaller than 22 [mm].

From a viewpoint of a driving mechanism and achievement of equivalent durability for the three augers, the three augers are designed to have substantially the same number of revolutions, and the same lead widths with the lead angles of not greater than 30 degrees. In this case, the lead width of the supply and conveyance auger is a width of a lead at the upstream side in the conveyance direction. The above design leads to bare minimum of the outside diameter of the auger to satisfy the amount of the conveyed developer shown in FIG. 11.

As a result, when R1, R2, and R3 represent the outside diameters of the supply and conveyance auger 8, the collection and conveyance auger 6, and the agitation and conveyance auger 11, respectively, the following relationship holds true:

$$R2>R1>R3$$

In other words, when the outside diameters of the three augers satisfy the above inequality, the substantially equal numbers of revolutions and lead widths can be achieved. Further, use of augers having the minimum outside diameters prevents a development device from being excessively upsized.

According to the above consideration, the three augers are designed to have the following values.

Agitation and conveyance auger 11:
Outside diameter=ϕ26 [mm]
Lead width=36 [mm] (double-thread)
Supply and conveyance auger 8:
Outside diameter=22 [mm]
Lead width=36 to 10 [mm]
(double-thread and single thread)
Collection and conveyance auger 6:
Outside diameter=ϕ19 [mm]
Lead width=34 [mm] (double-thread)

Next, the supply and conveyance auger 8 is described below. The supply and conveyance auger 8 has different lead widths between the upstream and downstream sides, and the number of the auger threads is changed from two to one.

Figure 13:
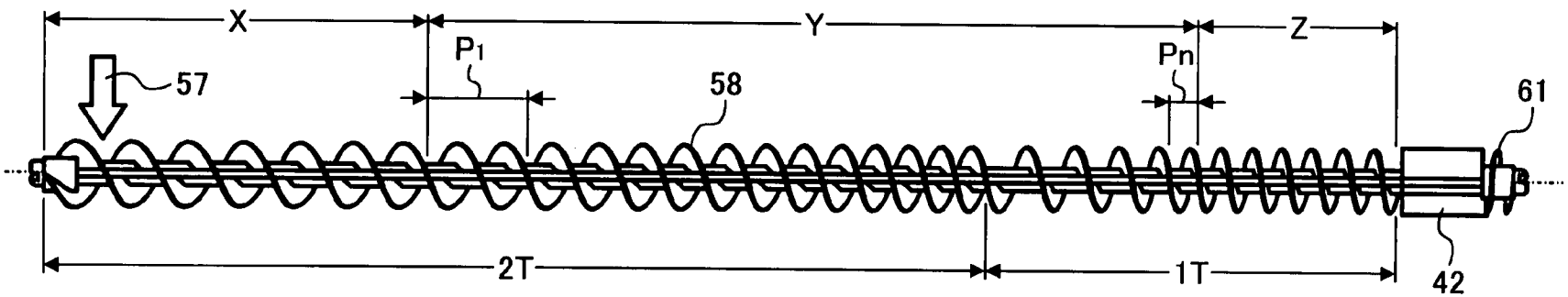
FIG. 13 is a detailed view of a supply and conveyance auger according to the embodiment of the present invention.

As shown in FIG. 13, the supply and conveyance auger 8 includes the transverse paddle 42, a thread member 58, and a reverse thread member 61. The developer is transferred at an upstream side 57 from the neighboring agitation and conveyance path 10 into the supply and conveyance path 9, and is conveyed from left to right therein.

The supply and conveyance auger 8 has a fixed lead width (P1=36 [mm]) in a section X arranged upstream of the development area. At least in a section Y where the developer is supplied to the development roller 5, the lead width progressively changes from P1=36 [mm] toward Pn=10 [mm], where Pn represents a width of a n-th lead after the lead width starts changing. In a section Z arranged downstream of the development area, the supply and conveyance auger 8 has a fixed lead width (Pn=10 [mm]).

Therefore, though the amount of developer conveyed in the supply and conveyance path 9 decreases as the developer is supplied to the development roller 5, a depth of the developer therein is maintained at a substantially constant level.

According to the average thickness of 1.8 [mm] of the auger thread, and the above consideration, the number of the auger threads in the section Y is determined such that the supply and conveyance auger 8 includes the double-thread auger in a part 2T where the lead width is larger than 20 [mm], and the single-thread auger in a part 1T where the lead width is not larger than 20 [mm]. The supply and conveyance auger 8 may have lead widths in arithmetic progression instead. In either case, it is preferable that lead widths progressively change.

Surplus developer is conveyed without having been used for development to the downstream end of the supply and conveyance path 9, and is transferred by the transverse paddle 42 to the agitation and conveyance path 10 at the opposite side together with collected developer transferred from the neighboring collection and conveyance path 7. The supply and conveyance auger 8 is provided with a reverse thread 61 (two turns with a lead width of 5 [mm]) having a thread in reverse to the thread member 58 in an area between the transverse paddle 42 and a bearing (not shown). The reverse thread 61 conveys the developer in a direction opposite to the conveyance direction so that the developer is not fed to the bearing and so forth.

Next, the doctor 16 and the regulated developer collection member 18 are described below referring to FIG. 14. The doctor 16 serves as a developer regulation member. The regulated developer collection member 18 collects developer regulated by the doctor 16.

Figure 14:
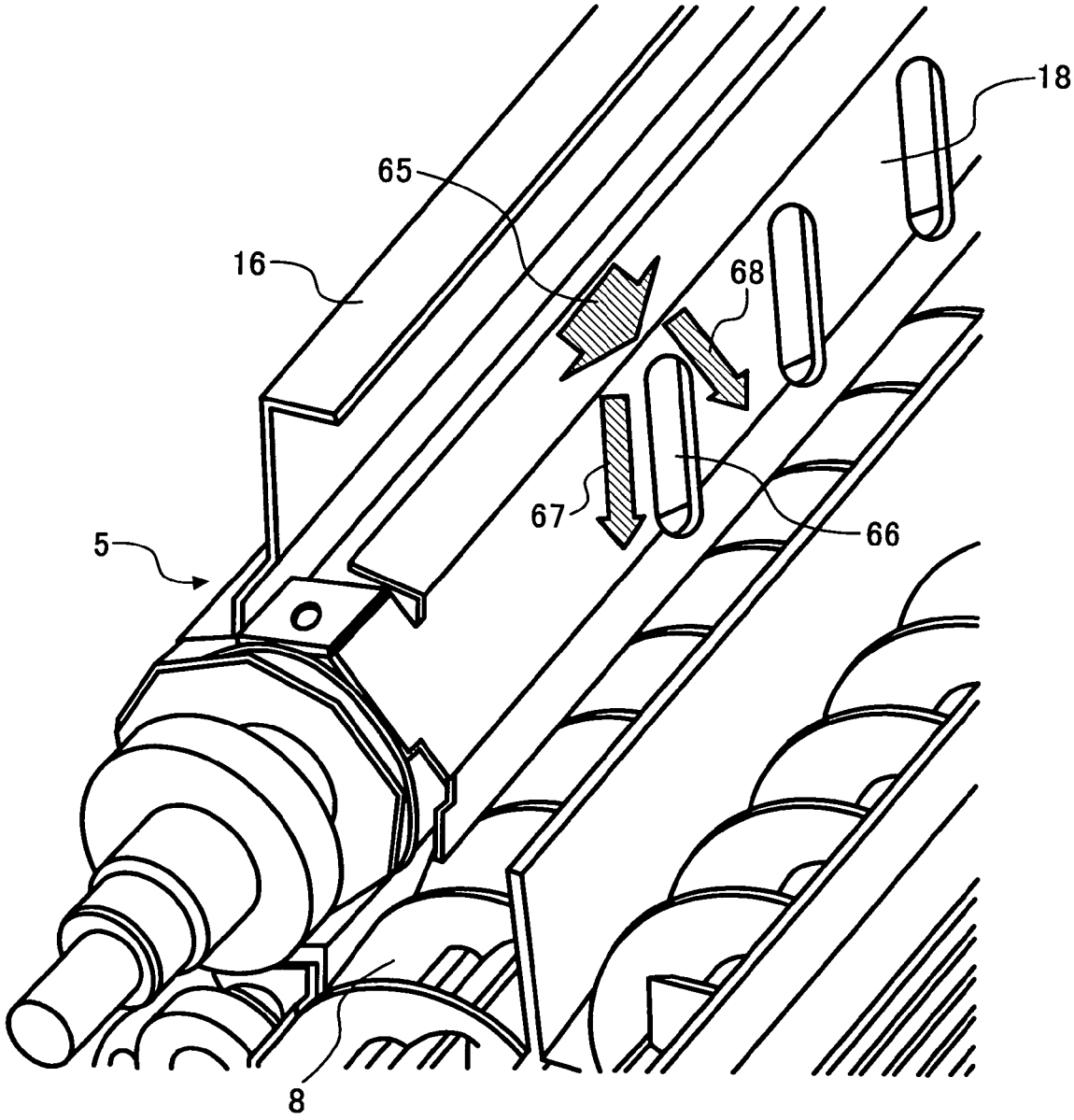
FIG. 14 is a perspective view of a doctor and members arranged in the vicinity thereof according to the embodiment of the present invention.

As shown in FIG. 14, the development device 4 includes the doctor 16, the regulated developer collection member 18, and the adjustment plate 66 shown in FIG. 6.

When the supply and conveyance auger 8 supplies developer to the development roller 5, the developer is regulated by the doctor 16 so that the developer on the development roller 5 has a constant thickness suitable for development. Since an amount of developer supplied to the development roller 5 is larger than an amount of developer regulated by the doctor 16, the regulated developer gradually resides upstream of the doctor 16. When the amount of the residing developer exceeds a predetermined amount, the developer overflows onto the regulated developer collection member 18. The regulated developer collection member 18 is provided with the adjustment plate 66 which causes a part of overflowed developer 65 to fall onto the upstream side in the conveyance direction of the supply and conveyance auger 8 (as indicated by an arrow 67), and another part of the overflowed developer 65 to directly fall onto the supply and conveyance auger 8 (as indicated by an arrow 68).

In the development device 4 according to the embodiment of the present invention, the collected developer is conveyed to the downstream end in the conveyance direction of the collection and conveyance path 7, and is transferred into the supply and conveyance path 9. Then, the collected developer is transferred together with the surplus developer into the agitation and conveyance path 10.

The surplus developer has a toner concentration suitable for development since the surplus developer has not been used for development. On the other hand, the collected developer has a lowered toner concentration. When the surplus developer and the collected developer are mixed, and are added with toner, the suitable toner concentration of the surplus developer is changed, and agitation is unnecessarily performed. When the surplus developer is added with the toner, the toner concentration of the surplus developer temporarily rises, thereby requiring a longer time for the entire surplus developer to have an even toner concentration.

A development device 4*a* according to another embodiment of the present invention is described below referring to FIG. 15. The same reference numerals as the reference numerals used in the drawings of the development device 4 represent the same members, and explanations thereof are omitted.

Figure 15:
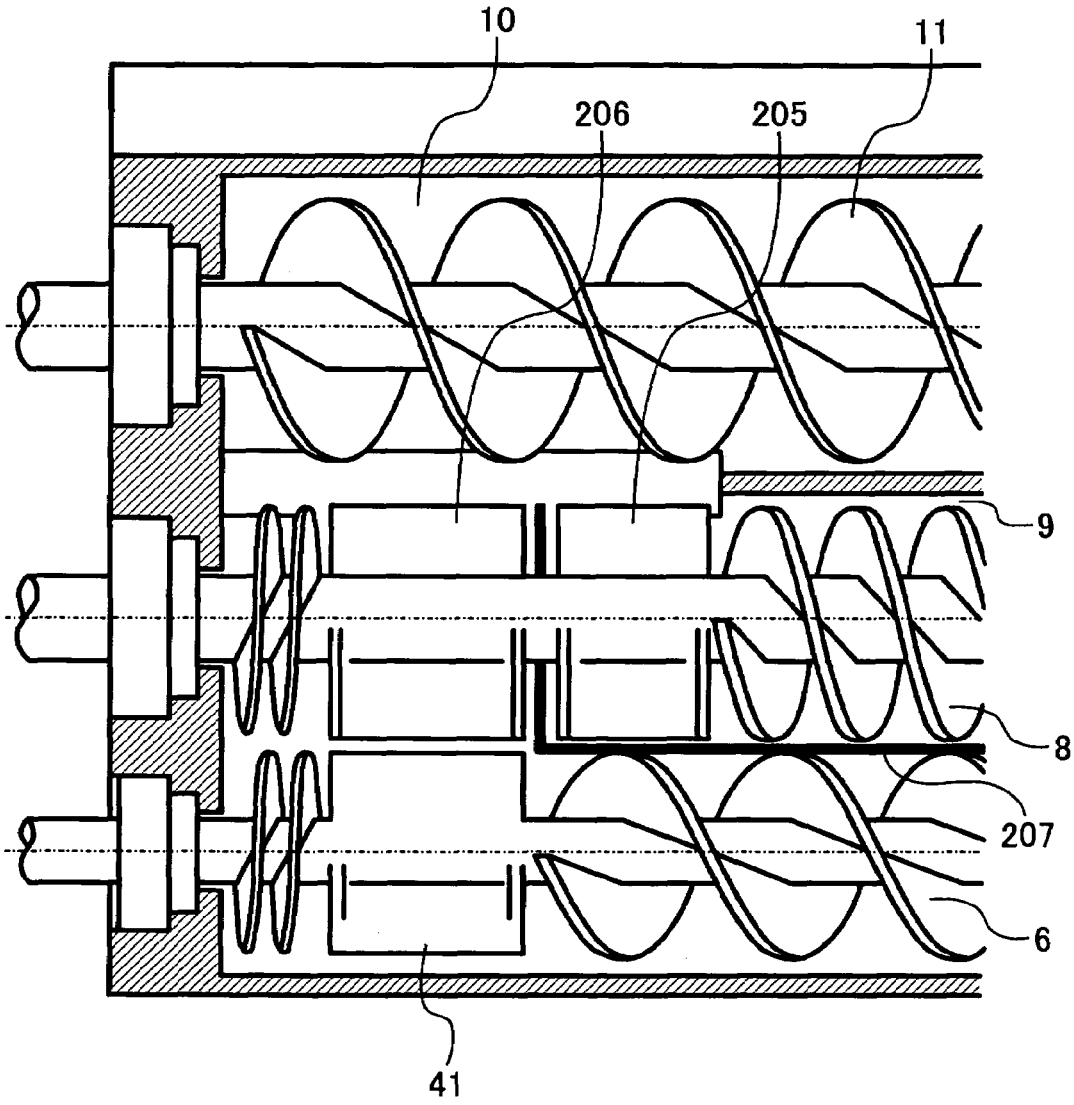
FIG. 15 is a schematic illustration of a configuration of a development device according to another embodiment of the present invention.

FIG. 15 illustrates a part of the development device 4*a*, located at downstream ends in conveyance directions of the supply and conveyance path 9 and the collection and conveyance path 7, and at an upstream end in conveyance direction of the agitation and conveyance path 10.

As shown in FIG. 15, the development device 4*a* according to the embodiment of the present invention includes the transverse paddle 41, and a first paddle 205 and a second paddle 206 instead of the transverse paddle 42 shown in FIG. 8. The development device 4*a* further includes a partition 207.

The first paddle 205 is arranged at the downstream end in the conveyance direction of the supply and conveyance auger 8. The first paddle 205 transfers the surplus developer into the agitation and conveyance path 10. The second paddle 206 is arranged on the same shaft as the first paddle 205. The second paddle 206 transfers the collected developer transferred by the transverse paddle 41 from the collection and conveyance path 6 further into the agitation and conveyance path 10.

The partition 207 is arranged between the first paddle 205 and the second paddle 206 so that the collected developer and the surplus developer are not mixed. The partition 207 is arranged so as not to interfere with rotations of axes of the first and second paddles 205 and 206. The partition 207 is provided with a hole (not shown) having a diameter not allowing the developer to go through.

A width of the second paddle 206 is larger than a width of the first paddle 205 based on a difference in required amounts of the developer to be transferred. A transfer channel including the transverse paddle 41 and the second paddle 206 is provided with a toner replenishment opening (not shown), and toner is supplied to the collected developer.

The agitation and conveyance auger 11 located in the agitation and conveyance path 10 agitates the collected developer having been added with the toner, and the surplus developer. Since transferring channels for the surplus developer and the collected developer are separated in the development device 4*a* according to the embodiment of the present invention, only the collected developer having the lowered toner concentration is added with the toner. Therefore, the collected developer and the added toner are agitated before the collected developer is mixed with the entire developer. As a result, the toner concentration of the developer can be quickly recovered, and an even toner concentration can be achieved.

Numerous additional modifications and variations are possible in light of the above teachings. It is therefore to be understood that within the scope of the appended claims, the disclosure of this patent specification may be practiced otherwise than as specifically described herein.

This patent specification is based on a Japanese patent application, No. JP2005-068659 filed on Mar. 11, in the Japan Patent Office, the entire contents of which are incorporated by reference herein.

What is claimed as new and desired to be secured by Letters Patent of the United States is:

1. A development device, comprising:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member configured to regulate the developer on the developer bearing member;

a developer collection and conveyance path including a developer collection and conveyance member configured to convey the developer in a second direction parallel to the first direction, arranged directly below the development bearing member and at a substantially same height as a height of the developer supply and conveyance path wherein at least a portion of the developer collection and conveyance member lies on a vertical line that crosses the development bearing member;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path.

2. The development device according to claim 1, wherein:

the developer supply and conveyance member are arranged to supply a part of the developer to the developer bearing member, and convey another part of the developer as surplus developer to a downstream end in the first direction;

the supplied developer is collected from the development bearing member after the developer passes by a position facing the latent image bearing member on the developer bearing member;

the developer collection and conveyance member is arranged to be supplied with the collected developer, and to convey the collected developer to a downstream end in the second direction;

the developer agitation and conveyance member is arranged to be supplied with the surplus and collected developer, and to convey the surplus and collected developer to a downstream end in the third direction while agitating the surplus and collected developer; and the agitated developer is supplied to the developer supply and conveyance member.

3. The development device according to claim 1, further comprising a shared transfer channel which connects the downstream ends of the developer supply and conveyance path and the developer collection and conveyance path with an upstream end of the developer agitation and conveyance path, so that the collected developer and the surplus developer are supplied into the developer agitation and conveyance path through the shared transfer channel, wherein the shared transfer channel is supplied with, in the vicinity of the downstream end of the developer collection and conveyance path, the toner according to an amount of toner consumed by development.

4. The development device according to claim 1, further comprising a surplus developer transfer channel which connects the downstream end of the developer supply and conveyance path with an upstream end of the developer agitation and conveyance path, and a collected developer transfer channel which connects the downstream end of the developer collection and conveyance path with the upstream end of the developer agitation and conveyance path, so that the surplus developer in the developer supply and conveyance path and the collected developer in the developer collection and conveyance path are separately supplied into the developer agitation and conveyance path, wherein the collected developer transfer channel is supplied with, in the vicinity of the downstream end of the developer collection and conveyance path, the toner according to an amount of toner consumed by development.

5. The development device, according to claim 1, wherein the developer supply and conveyance member, the developer collection and conveyance member, and the developer agitation and conveyance member include respective shafts having helical shapes in main sections, serving as augers for conveying the developer in the first, second, and third directions, respectively, while rotating, wherein the developer supply and conveyance member includes a developer supply and conveyance auger, the developer collection and conveyance member includes a developer collection and conveyance auger, and the develop agitation and conveyance member includes a developer agitation and conveyance auger.

6. The development device according to claim 5, wherein a diameter R1 of the developer supply and conveyance auger is larger than a diameter R2 of the developer collection and conveyance auger, and is smaller than a diameter R3 of the developer agitation and conveyance auger.

7. The development device according to claim 6, wherein the developer supply and conveyance member is arranged and configured such that an amount of developer conveyed by the developer supply and conveyance member becomes smaller as the developer is conveyed downstream in the conveyance direction.

8. The development device according to claim 7, wherein a lead width of the developer supply and conveyance auger becomes smaller along the first direction.

9. The development device according to claim 8, wherein the developer supply and conveyance auger includes a plurality of threads at an upstream side in the first direction, and a number of the threads provided at the upstream side is larger than a number of the threads provided at a downstream side in the first direction.

10. The development device according to claim 9, wherein the developer supply and conveyance auger includes two threads at the upstream side and one thread at the downstream side, wherein the two threads are provided in a section in which the lead width is not less than 11 times as large as an average thickness of the threads.

11. The development device according to claim 10, wherein the developer supply and conveyance member is arranged such that a top portion thereof is located lower than a central axis of rotation of the developer bearing member, and that a plane passing through the top portion thereof and the central axis of rotation of the developer bearing member forms an angle of between 10 to 40 degrees with a horizontal plane passing through the central axis of rotation of the developer bearing member.

12. The development device according to claim 11, wherein:

the plurality of magnetic poles included in the developer bearing member include a first magnetic pole and a second magnetic pole;

the first magnetic pole is located in a position facing the developer supply and conveyance member to draw the developer being conveyed thereby;

the second magnetic pole is located at an upstream side of the first magnetic pole in a move direction of the developer on a surface of the developer bearing member; and the first and second magnetic poles are arranged such that an angle between the first and second magnetic poles is not smaller than 100 degrees relative to the central axis of rotation of the developer bearing member.

13. The development device according to claim 12, further comprising a regulated developer collection member configured to collect developer regulated by the developer regulation member after the developer is supplied by the developer supply and conveyance member from the developer supply and conveyance path onto the developer bearing member, and to return the collected developer into the developer supply and conveyance path, wherein the regulated developer collection member returns at least a part of the collected developer to the upstream side of a position in which the developer is collected in the conveyance direction of the developer supply and conveyance member.

14. The development device according to claim 13, wherein the developer supply and conveyance path and the developer agitation and conveyance path are arranged next to each other with the partition member located in between, wherein the partition member includes a volume adjustment opening so as to transfer the developer from the developer supply and conveyance path into the developer agitation and conveyance path when a volume of the developer conveyed in the developer supply and conveyance path exceeds a predetermined level.

15. A development device comprising:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member;

a developer regulation member configured to regulate the developer on the developer bearing member;

a developer collection and conveyance path including a developer collection and conveyance member configured to convey the developer in a second direction parallel to the first direction, arranged below the development bearing member and at a substantially same height as a height of the developer supply and conveyance path;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path, wherein the developer supply and conveyance member, the developer collection and conveyance member, and the developer agitation and conveyance member include respective shafts having helical shapes in main sections, serving as augers for conveying the developer in the first, second, and third directions, respectively, while rotating, wherein the developer supply and conveyance member includes a developer supply and conveyance auger, the developer collection and conveyance member includes a developer collection and conveyance auger, and the develop agitation and conveyance member includes a developer agitation and conveyance auger, wherein the shafts each have, at the downstream ends thereof, another helical shape for conveying the developer in directions opposite to the first, second, and third directions.

16. A development device, comprising:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including developer supply and conveyance means for conveying the developer in a first direction parallel to an axial direction of the developer bearing member and for supplying the developer directly to the developer bearing member;

developer regulation means for regulating the developer on the developer bearing member;

a developer collection and conveyance path including developer collection and conveyance means for conveying the developer in a second direction parallel to the first direction, arranged directly below the development bearing member and at a substantially same height as a height of the developer supply and conveyance path;

a developer agitation and conveyance path including developer agitation and conveyance means for conveying the developer in a third direction opposite to the first direction, arranged at a substantially same height as the height of the developer collection and conveyance path; and partition members partitioning the developer supply and conveyance path, the developer collection and conveyance path, and the developer agitation and conveyance path, wherein the developer collection and conveyance means is configured to collect the developer directly from the developer bearing member.

17. A process cartridge attachable to and detachable from an image forming apparatus, at least integrally comprising:

a latent image bearing member configured to bear a latent image; and a development device configured to develop the latent image, including:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member;

a developer collection and conveyance path including a developer collection and conveyance member configured to convey the developer in a second direction parallel to the first direction, arranged directly below the development bearing member and at a substantially same height as a height of the developer supply and conveyance path wherein at least a portion of the developer collection and conveyance member lies on a vertical line that crosses the development bearing member;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path.

18. An image forming apparatus, at least comprising:

a latent image bearing member;

a charger for charging a surface of the latent image bearing member;

a latent image forming device for forming an electrostatic latent image on the latent image bearing member; and a development device for developing the electrostatic latent image into a toner image, including:

a developer bearing member including a plurality of magnetic poles for bearing a developer including a magnetic carrier and toner, wherein the developer bearing member rotates so that the toner is supplied to the electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member;

a developer collection and conveyance path including a developer collection and conveyance member configured to convey the developer in a second direction parallel to the first direction, arranged directly below the development bearing member and at a substantially same height as a height of the developer supply and conveyance path, wherein at least a portion of the developer collection and conveyance member lies on a vertical line that crosses the development bearing member;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path.

19. A development method, comprising the steps of:

rotating a developer bearing member including a plurality of magnetic poles for bearing a developer including a magnetic carrier and toner so that the toner is supplied to an electrostatic latent image formed in a position facing the developer bearing member on a surface of a latent image bearing member, conveying the developer by a developer supply and conveyance member in a developer supply and conveyance path in a first direction parallel to an axial direction of the developer bearing member;

supplying the developer directly to the developer bearing member by the developer supply and conveyance member;

supplying and conveying the developer to the developer bearing member;

regulating the developer on the developer bearing member;

collecting and conveying the developer directly from the developer bearing member by a developer collection and conveyance member in a developer collection and conveyance path in a second direction parallel to the first direction;

agitating and conveying the collected developer and surplus developer by a developer agitation and conveyance member in a developer agitation and conveyance path in a third direction opposite to the first direction; and transferring the developer from the developer agitation and conveyance path to the developer supply and conveyance path.

20. A development device, comprising:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including developer supply and conveyance means for conveying the developer in a first direction parallel to an axial direction of the developer bearing member and for supplying the developer directly to the developer bearing member;

developer regulation means for regulating the developer on the developer bearing member;

a developer collection and conveyance path including developer collection and conveyance means for conveying the developer in a second direction parallel to the first direction, arranged directly below the development bearing member and at a substantially same height as a height of the developer supply and conveyance path, wherein at least a portion of the developer collection and conveyance means lies on a vertical line that crosses the development bearing member;

a developer agitation and conveyance path including developer agitation and conveyance means for conveying the developer in a third direction opposite to the first direction, arranged at a substantially same height as the height of the developer collection and conveyance path; and partition members partitioning the developer supply and conveyance path, the developer collection and conveyance path, and the developer agitation and conveyance path.

21. A development device, comprising:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member configured to regulate the developer on the developer bearing member;

a developer collection and conveyance path including a developer collection and conveyance member configured to convey the developer in a second direction parallel to the first direction, arranged directly below the development bearing member and at a substantially same height as a height of the developer supply and conveyance path;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path, wherein the developer collection and conveyance member is configured to collect the developer directly from the developer bearing member.

22. A process cartridge attachable to and detachable from an image forming apparatus, at least integrally comprising:

a latent image bearing member configured to bear a latent image; and a development device configured to develop the latent image, including:

a developer bearing member including a plurality of magnetic poles for bearing a developer including a magnetic carrier and toner, wherein the developer bearing member rotates so that the toner is supplied to an electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member;

a developer collection and conveyance path including a developer collection and conveyance member configured to convey the developer in a second direction parallel to the first direction, arranged directly below the development bearing member and at a substantially same height as a height of the developer supply and conveyance path;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path, wherein the developer collection and conveyance member is configured to collect the developer directly from the developer bearing member.

23. An image forming apparatus, at least comprising:

a latent image bearing member;

a charger for charging a surface of the latent image bearing member;

a latent image forming device for forming an electrostatic latent image on the latent image bearing member; and a development device for developing the electrostatic latent image into a toner image, including:

a developer bearing member including a plurality of magnetic poles for bearing a developer including a magnetic carrier and toner, wherein the developer bearing member rotates so that the toner is supplied to the electrostatic latent image formed in a position facing the developer bearing member on a surface of a latent image bearing member;

a developer supply and conveyance path including a developer supply and conveyance member configured to convey the developer in a first direction parallel to an axial direction of the developer bearing member and to supply the developer directly to the developer bearing member;

a developer regulation member;

a developer collection and conveyance path including a developer collection and conveyance member configured to convey the developer in a second direction parallel to the first direction, arranged directly below the development bearing member and at a substantially same height as a height of the developer supply and conveyance path;

a developer agitation and conveyance path including a developer agitation and conveyance member configured to convey the developer in a third direction opposite to the first direction, arranged at a substantially same height as the height of the developer collection and conveyance path; and partition members partitioning the developer supply and conveyance path, the developer collection and conveyance path, and the developer agitation and conveyance path, wherein the developer collection and conveyance member is configured to collect the developer directly from the developer bearing member.

* * * * *